US011608959B2

(12) United States Patent
Nykerk et al.

(10) Patent No.: US 11,608,959 B2
(45) **Date of Patent: *Mar. 21, 2023**

(54) SEGMENTED SWITCHABLE MIRROR LAMP ASSEMBLY

(71) Applicant: Flex-N-Gate Advanced Product Development, LLC, Tecumeseh (CA)

(72) Inventors: Todd Nykerk, Holland, MI (US); David Bjarne Hansen, Grand Rapids, MI (US); Jeffrey Simchak, Dexter, MI (US)

(73) Assignee: Flex-N-Gate Advanced Product Development, LLC, Tecumseh (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/554,800

(22) Filed: Dec. 17, 2021

(65) Prior Publication Data

US 2022/0107073 A1 Apr. 7, 2022

Related U.S. Application Data

(63) Continuation of application No. 16/906,533, filed on Jun. 19, 2020, now Pat. No. 11,204,148.

(Continued)

(51) Int. Cl.
*F21S 41/675* (2018.01)
*F21S 41/153* (2018.01)

(Continued)

(52) U.S. Cl.
CPC ..... *F21S 41/675* (2018.01); *F21S 41/153* (2018.01); *F21W 2102/13* (2018.01); *F21Y 2115/10* (2016.08)

(58) Field of Classification Search
CPC ..... F21S 41/675; F21S 41/147; F21S 43/14; F21S 41/25; F21W 2102/13
See application file for complete search history.

(56) References Cited

U.S. PATENT DOCUMENTS 5,938,319 A * 8/1999 Hege ..... F21S 41/675 362/466
7,679,808 B2 3/2010 Kim (Continued)

FOREIGN PATENT DOCUMENTS

CN 1162714 A 10/1997
DE 102013020549 A1 6/2015

(Continued)

OTHER PUBLICATIONS

European Patent Application 20825926.7 European Search Report dated May 19, 2022.

(Continued)

*Primary Examiner* — Evan P Dzierzynski
(74) *Attorney, Agent, or Firm* — Avek IP, LLC

(57) ABSTRACT

A segmented switchable mirror vehicle headlamp includes a light source, a switchable electrochemical film having a plurality of segments, and a controller electrically coupled with each segment of the plurality of segments, such that each segment of the plurality of segments is individually controllable for switching between a substantially transparent state and a substantially reflective state. The plurality of segments include a low-beam array of segments configured for providing a low-beam light distribution from the light source, and a high-beam array of segments configured for providing a high-beam light distribution from the light source. The controller is configured for switching the low-beam array of segments and the high-beam array of segments between the substantially transparent state and the substantially reflective state for controlling the low-beam light distribution and the high-beam light distribution, respectively.

20 Claims, 14 Drawing Sheets

Related U.S. Application Data

(60) Provisional application No. 62/864,591, filed on Jun. 21, 2019.

(51) Int. Cl.
*F21W 102/13* (2018.01)
*F21Y 115/10* (2016.01)

(56) References Cited

U.S. PATENT DOCUMENTS

| | | | | |
|---|---|---|---|---|
| 8,179,588 | B2 | 5/2012 | Yamada et al. | |
| 9,254,789 | B2 | 2/2016 | Anderson et al. | |
| 2003/0002291 | A1 | 1/2003 | Strazzanti | |
| 2003/0107323 | A1 | 6/2003 | Stam | |
| 2003/0156425 | A1 | 8/2003 | Turnbell et al. | |
| 2013/0107559 | A1* | 5/2013 | Gava | F21S 41/645 362/539 |
| 2015/0219305 | A1* | 8/2015 | Michiels | G02B 19/0066 362/240 |
| 2018/0320884 | A1 | 11/2018 | Salter et al. | |
| 2019/0283663 | A1* | 9/2019 | Ohgitani | B60Q 1/04 |

FOREIGN PATENT DOCUMENTS

| | | | |
|---|---|---|---|
| EP | 3026332 | A2 | 6/2016 |
| EP | 3401591 | A1 | 11/2018 |
| JP | 1996248451 | | 9/1996 |
| JP | H08248451 | A | 9/1996 |
| KR | 20130136111 | A | 12/2013 |
| KR | 101469697 | B1 | 12/2014 |

OTHER PUBLICATIONS

PCT Patent Application PCT/US2020/038671 International Search Report and Written Opinion; dated Aug. 27, 2020.

* cited by examiner

SEGMENTED SWITCHABLE MIRROR LAMP ASSEMBLY

CROSS-REFERENCE TO RELATED APPLICATIONS

This application claims the benefit of U.S. Provisional Patent Application No. 62/864,591 filed on Jun. 21, 2019, and U.S. patent application Ser. No. 16/906,533 filed on Jun. 19, 2020, which are both entitled "Segmented Switchable Mirror Lamp Assembly" and are both herein incorporated by reference in their entirety.

BACKGROUND

1. Field of the Disclosure

Embodiments of this disclosure relate generally to vehicle lamps. More specifically, embodiments of this disclosure include lamps configured to provide segmented shuttering and a changeable outward appearance.

2. Description of the Related Art

Various switchable mirror devices are known. For example, U.S. Pat. No. 7,679,808 to Kim discloses a portable electronic device having a switchable mirror display capable of switching between a transparent state and a reflecting state. U.S. Pat. No. 9,254,789 to Anderson et al. discloses a rearview mirror assembly that includes a switchable mirror system. U.S. Pat. No. 8,179,588 to Yamada et al. discloses a switchable mirror element having a switchable layer to be reversibly changed from a transparent state to a mirror state.

SUMMARY

In an embodiment, a segmented switchable mirror vehicle headlamp includes a light source, a switchable electrochemical film having a plurality of segments, and a controller electrically coupled with each segment of the plurality of segments, such that each segment of the plurality of segments is individually controllable for switching between a substantially transparent state and a substantially reflective state. The plurality of segments include a low-beam array of segments configured for providing a low-beam light distribution from the light source, and a high-beam array of segments configured for providing a high-beam light distribution from the light source. The controller is configured for switching the low-beam array of segments and the high-beam array of segments between the substantially transparent state and the substantially reflective state for controlling the low-beam light distribution and the high-beam light distribution, respectively.

In another embodiment, an adaptable-driving-beam headlamp for a vehicle includes a plurality of light-emitting diodes (LEDs) mounted on one or more printed circuit board, an inner lens aligned with the plurality of LEDs for shaping light emitted therefrom, an outer lens adapted to receive light from the inner lens and project the light from the vehicle, a camera system for imaging a forward view from the vehicle, and a controller adapted for determining a target location based on images received from the camera system. The outer lens includes a first transparent layer and a second transparent layer adjacent the first transparent layer, a switchable electrochemical film disposed between the first transparent layer and the second transparent layer, wherein the switchable electrochemical film includes a plurality of film segments. The plurality of film segments are each individually controllable via the controller such that each of the plurality of film segments is switchable between a substantially transparent state and a substantially opaque state for actively dimming a portion of light projected from the outer lens based on the target location.

A switchable-mirror adaptable-driving-beam headlamp for a vehicle includes a switchable mirror having a plurality of electrochemical film segments, a controller electrically coupled with each segment of the plurality of electrochemical film segments, such that each segment is individually controllable for switching between a substantially transparent state and a substantially reflective state, and a collimated light source directed at the switchable mirror such that each segment in the substantially reflective state reflects light from the collimated light source for projecting from a vehicle headlamp, and each segment in the substantially transparent state does not reflect light from the collimated light source.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
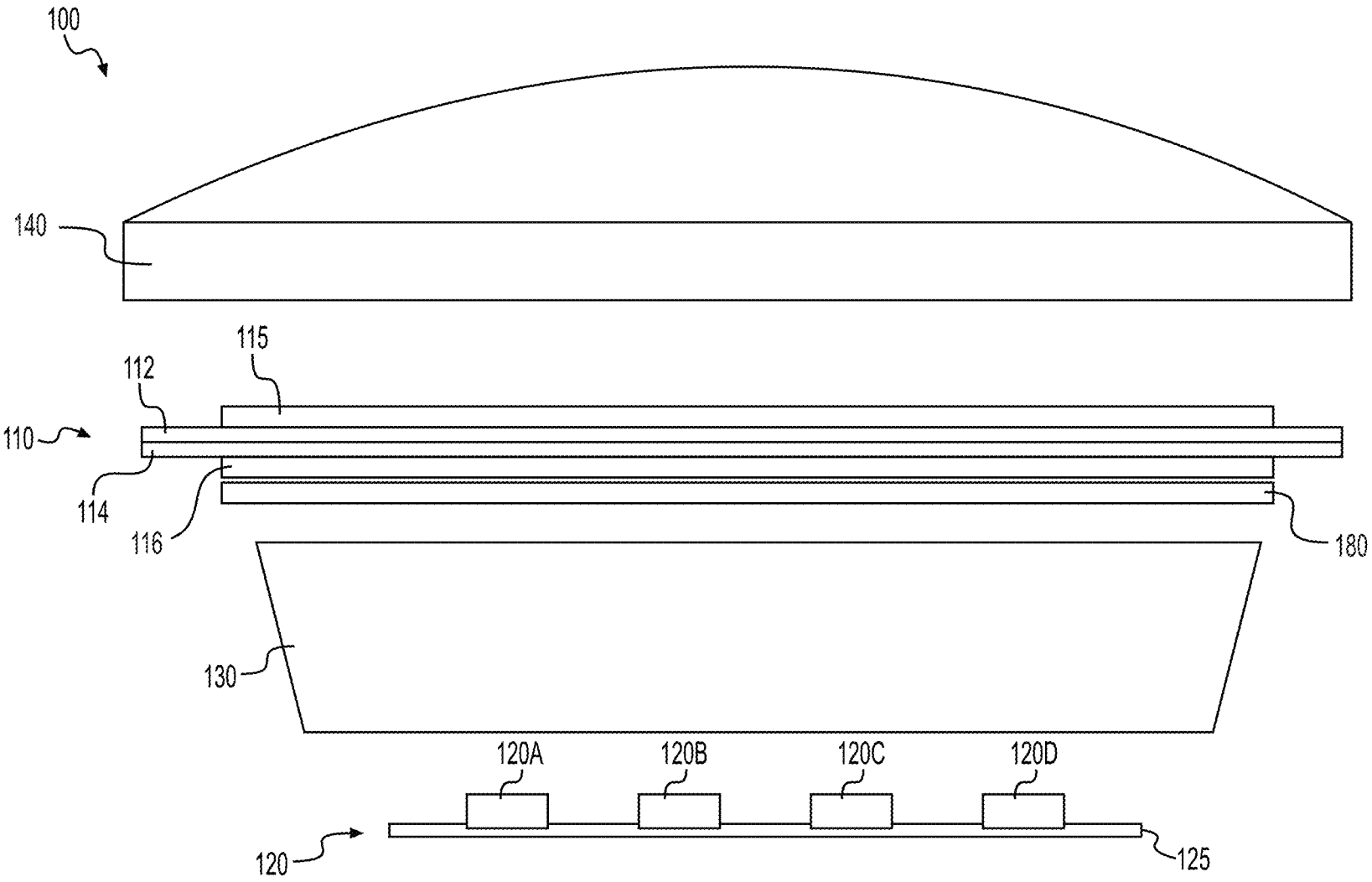
FIG. 1 is an exploded side view of an exemplary segmented switchable lens adaptable-driving-beam (ADB) lamp assembly, in an embodiment.

FIG. 1 is an exploded side view of an exemplary segmented switchable lens adaptable-driving-beam (ADB)

lamp assembly 100. The exploded view of FIG. 1 separates components for clarity of illustration that may otherwise be closer together or physically connected when functionally assembled. Lamp assembly 100 includes a segmented switchable lens 110, a light source 120, and an inner lens 130. Optionally, an outer lens 140 may be provided to produce a desired light distribution.

Light source 120 is, for example, an array of light-emitting diodes (LEDs) mounted to a printed-circuit board (PCB) 125. As depicted in FIG. 1, light source 120 includes a plurality of LEDs, namely a first LED 120A, a second LED 120B, a third LED 120C, and a fourth LED 120D. Other types of light sources and arrangements, including greater or fewer than four LEDs, may be substituted for the depicted LED array, without departing from the scope hereof. Light source 120 may be configured as a low-beam and/or high-beam light source of a headlamp, for example. PCB 125 may be communicatively coupled with a controller (e.g., a controller 350 described below in connection with FIG. 3) for individually controlling each of the LEDs 120A-120D. For example, the individual LEDs may be turned on/off or dimmed, e.g., via pulse-width modulation (PWM), under control of the controller 350, as further described below.

Inner lens 130 may be any type of optic lens adapted for projecting light from light source 120. In certain embodiments, inner lens 130 is an ADB matrix lens having a plurality of inner lenses adapted for shaping light from light source 120. For example, each inner lens may be a projection-type lens that includes optic elements centered over a respective LED of light source 120. Exemplary ADB matrix lenses are described in pending U.S. application Ser. No. 16/598,403, entitled Light Module and filed on Oct. 10, 2019, and U.S. application Ser. No. 16/561,640, entitled Vehicle Adaptable Driving Beam Headlamp and filed on Sep. 5, 2019. The entireties of these applications are herein incorporated by reference.

Segmented switchable lens 110 includes four layers of a transparent material such as plastic or glass that provide substrates for supporting electrochemical films and electrodes, which are configured for providing an adjustable transparency as described below. In certain embodiments, the transparent substrates are molded parts made of a clear or transparent plastic, such as polycarbonate or acrylic. The substrates may be molded into a variety of shapes having curvature, protrusions, indentations, grooves, recesses, bulges, etc. In the schematic diagram of FIG. 1, the numerals refer to electrochemical films and electrodes that are each deposited on a depicted transparent substrate. For example, a first electrochemical film 115 deposited on a substrate is disposed adjacent a first electrode 112 deposited on a substrate. Similarly, a second electrochemical film 116 deposited on a substrate is disposed adjacent a second electrode 114, also deposited on a substrate. The substrates may be held together using an optically clear adhesive. The first and second electrochemical films 115, 116 and the first and second electrodes 112, 114 are adapted to conform to the shape of the substrates. The first and second electrodes 112, 114 are used to electrically connect the first and second electrochemical films 115, 116 with an electrical power source (e.g., battery) for providing an electric potential across the electrochemical films 115, 116, respectively. The purpose for having two electrochemical films is to provide polarization of light in two directions. For example, film 115 may be configured to provide a right-hand helical light polarization, whereas film 116 may be configured to provide a left-hand helical light polarization, or vice versa. By having two sets of switchable films optically aligned with one another, light transmitted from segmented switchable lens 110 is polarized in both clockwise and counter-clockwise directions.

In certain embodiments, the first and second electrochemical films 115, 116 are formed of a thin film of polymer-dispersed liquid-crystals (e.g., as in a liquid-crystal display or "LCD"). Alternatively, in some embodiments, electrochemical films 115, 116 are formed a thin film of an electrochromic material such as a transition-metal hydride electrochromic. Yet in other embodiments, electrochemical films 115, 116 are a thin film laminate of particles suspended in liquid (e.g., as in a "suspended-particle device"). For all of these embodiments, a switch between transparent and non-transparent modes is controlled by a change in applied voltage. In addition to substantially transparent and substantially opaque states, different levels of semi-transparency or semi-opaqueness may be achieved by, for example, PWM of the applied electric potential, as further described below.

Electrochemical films 115, 116 may be divided into segments (e.g., 1-mm by 1-mm sized segments or larger) that are each independently adapted for switching between an active mode and an inactive mode. That is, the individual film segments may be wired separately for individually controlling their applied voltage. In this way, electrochemical films 115, 116 are adapted to provide a plurality of independently activated shutters or mirrors (see below), enabling greater variation and control of light emitted from lamp assembly 100. The individual segments of films 115, 116 may each be made substantially transparent, semi-transparent, or substantially opaque, e.g., under control of controller 350. The individual film segments may also be rapidly transitioned between the different transparency states under control of controller 350.

Outer lens 140 may be configured as a projection lens that receives light that passes through transparent segments of segmented switchable lens 110 and projects the light (e.g., in front of the vehicle). Outer lens 140 may be an undivided freeform optic surface, undivided aspheric surface, or undivided modified aspheric surface that generates one collective undivided image (e.g., in front of the vehicle) when lamp assembly 100 is lit. To improve beam image uniformity, an inner surface of outer lens (e.g., the "B surface" facing lens 110) may include pillow optics, flutes, or a swept optic surface, or it may be flat.

An optional heating element 180 may be provided with segmented switchable lens 110 for maintaining a predetermined minimum temperature (e.g., −40° C.) of the electrochemical films 115, 116 to maintain proper function. In an embodiment, heating element 180 includes a transparent conductive layer that is electrically powered to produce heat. The transparent conductive layer is, for example, a thin film layer of indium tin oxide (ITO) or silver nanowires configured to provide a transparent resistor. The transparent conductive layer may be disposed on a transparent substrate (e.g., clear plastic or glass). Other types of heating elements and/or other types of transparent conductive layers may be used without departing from the scope hereof.

Figure 2:
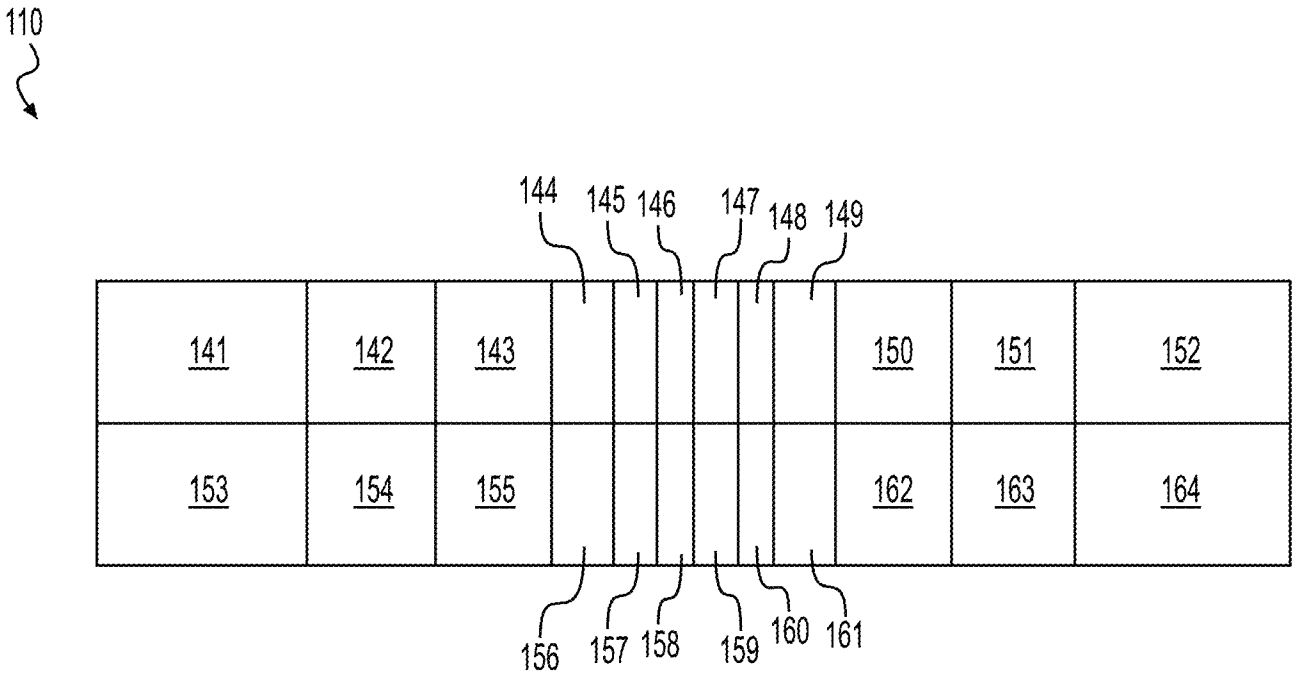
FIG. 2 is a front view of an embodiment of a segmented ADB matrix lens used in the segmented switchable lens ADB lamp assembly of FIG. 1.

FIG. 2 is a front view of an exemplary segmented switchable lens 110 having a plurality of segments adapted for providing an ADB function. In the embodiment depicted in FIG. 2, segmented switchable lens 110 includes a 2×12 array of segments 141-164, which are provided by independently-controlled segments of electrochemical films 115, 116. For example, a top row includes segments 141-152 and a bottom row includes segments 153-164. Segments of the first and second electrochemical films 115, 116 are matched in size and shape and optically aligned so that light passing through a segment of film 116 also passes through a corresponding segment of film 115 and is polarized in both the left-hand and right-hand directions. Lines between segments 151-164 are shown in FIG. 2 to illustrate individual segments; however, the lines between segments of lens 110 are not visible to the naked eye. For example, separation between segments of films 115, 116 may be small so as to limit light passing therebetween. For example, separation between segments may be less than one-hundred microns. In some embodiments, separation between segments is about twenty to about twenty-five microns.

Segments 141-164 may be formed on curved or planar surfaces and in a variety of shapes, such as those depicted in the 2×12 array of segments 141-164 of FIG. 2. Alternatively, the independently-controlled segments of electrochemical films 115, 116 are smaller than each of segments 141-164, and a plurality of smaller segments of films 115, 116 are collectively controlled to form the depicted segments 141-164.

In some embodiments, light source 120 includes a 2×12 LED-array having two rows of twelve LEDs such that each LED is aligned with a corresponding segment 141-164 of the segmented switchable lens 110 depicted in FIG. 2. Light source 120 may be used for automotive lighting functions including for example, a high beam and/or low beam of a headlamp, a stop signal, a turn signal, a taillight, or a center high-mounted stop lamp. The automotive lighting functions may be controlled via a vehicle controller, such as controller 350 described below in connection with FIG. 3.

Figure 5:
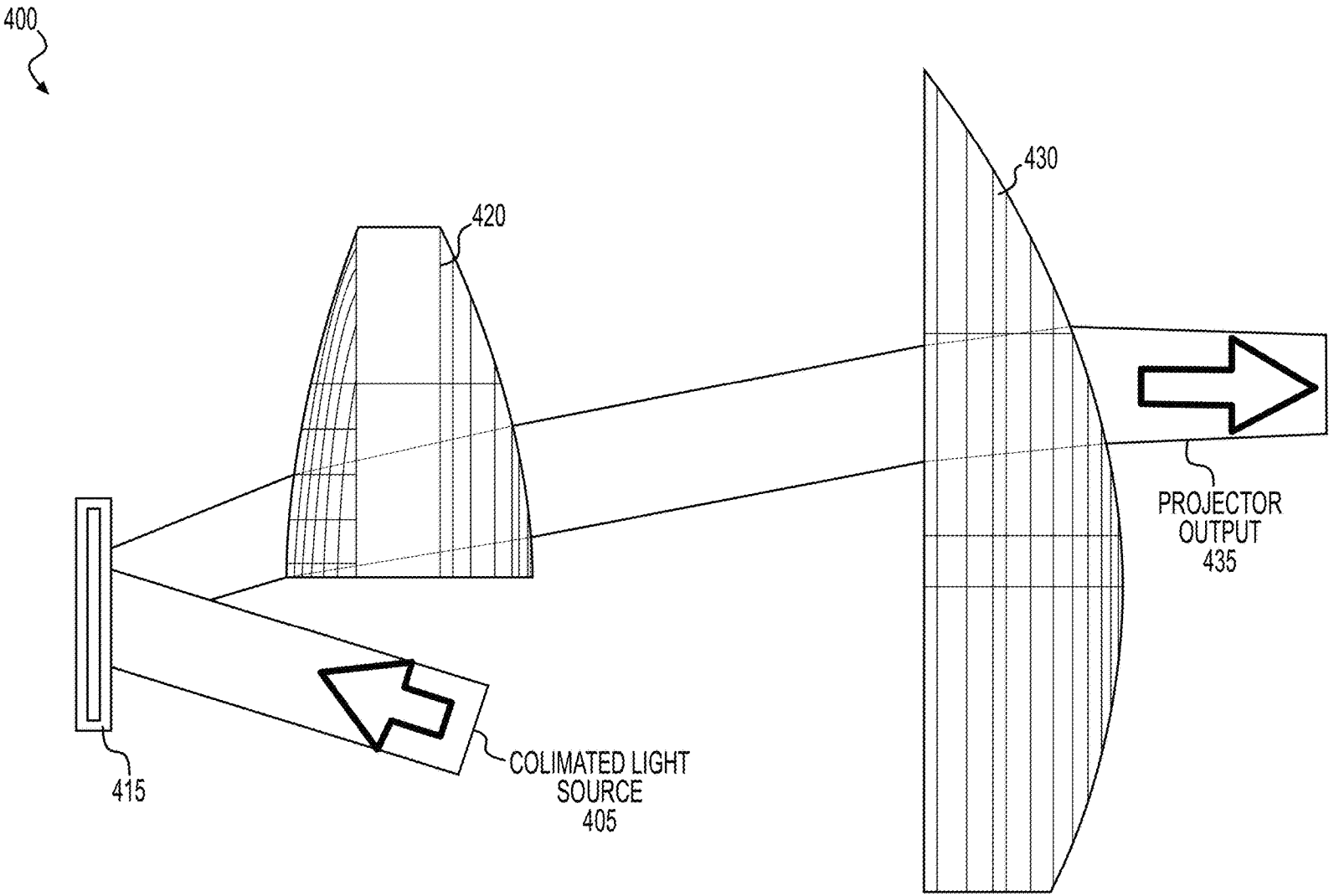
FIG. 5 is a side view of an ADB vehicle headlamp assembly, in an embodiment.

Segmented switchable lens 110 may be used in various lamp assemblies as an outer or inner lens (not shown), or alternatively as a mirror (e.g., as segmented switchable mirror 415 of FIG. 5). Lens 110 is attached to a housing (not shown) which provides structural support, enabling optical alignment for components and fixtures of lamp assembly 100, and for attaching to a separate structure (e.g., a vehicle). Lens 110 is configured as part of a vehicle lamp assembly, which includes but is not limited to headlight and taillight assemblies, center high-mounted stop lamps, fog lamps, turn signals, and reflectors. Lens 110 may be used to provide a switchable outward appearance of lamp assembly 100, such that lens 110 switchably conceals components of lamp assembly 100, including one or more light sources, inner lenses, reflex reflectors, bezels, etc. Lens 110 also provides shuttering capability for ADB functionality, as described below.

Figure 3:
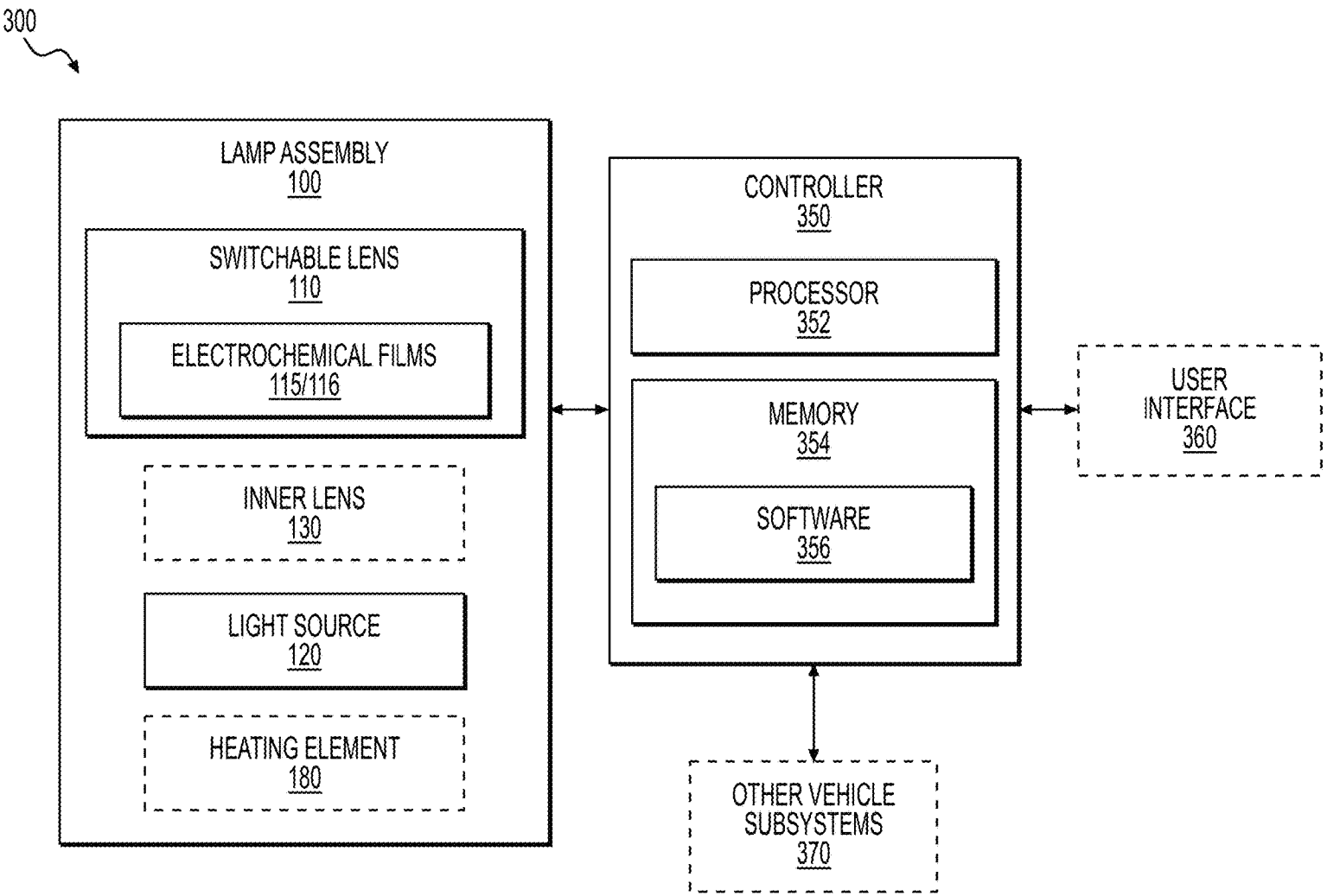
FIG. 3 is a block diagram showing components of an exemplary system for controlling the lamp assembly of FIG. 1, in an embodiment.

FIG. 3 is a block diagram showing components of an exemplary system 300 for controlling lamp assembly 100. System 300 includes a controller 350, which is for example a headlamp control module having a computer, a microcontroller, a microprocessor, or a programmable logic controller (PLC) and one or more PCBs located onboard the vehicle and communicatively coupled with the first and second electrochemical films 115, 116, light source 120 via PCB 125, and optionally inner lens 130 and heating element 180.

Controller 350 includes a memory 354, including a non-transitory medium for storing software 356, and a processor 352 for executing instructions of software 356. Memory 354 may be used to store information used by the controller, including but not limited to instructions, algorithms, lookup tables, and computational models. Controller 350 may further include one or more switches (e.g., for performing PWM). An optional user interface 360 enables a user to transmit instructions and receive information, as further described below. Controller 350 is not limited by the materials from which it is formed or the processing mechanisms employed therein and, as such, may be implemented via semiconductor(s) and/or transistors (e.g., electronic integrated circuits (ICs)), and so forth.

In certain embodiments, user interface 360 includes a user input device, which may include one or more buttons or switches located in a vehicle cabin or on a handheld device (e.g., a key fob) for controlling the lamp assembly 100. In some embodiments, user interface 360 includes a touch screen display device configured for receiving touch indications by the user. The touch screen display device may be located in the vehicle cabin and/or accessed remotely via a mobile device (e.g., smartphone, tablet, or laptop computer). User interface 360 may be configured to present a menu for selecting for example ADB settings, among other patterns of transparent/reflective states.

In certain embodiments, controller 350 is optionally coupled communicatively with other vehicle subsystems 370. This enables automatic control of the lamp assembly 100 based on input signals provided by other subsystems of the vehicle. For example, a camera subsystem may be used to image a vehicle's forward view. The images are transmitted to controller 350 for determining which segments of film 115 to turn off in real-time or near real-time to control light projected on a target location, based on the camera images, as further described below in connection with FIG. 3. In another example, lamp assembly 100 may be triggered to reveal a concealed stop light by making electrochemical films 115, 116 fully transparent in the active mode, in response to a stop signal provided by a sensor, the sensor being responsive to an activated braking mechanism. In an embodiment, when a user locks or unlocks the vehicle doors via a key fob, lamp assembly 100 may alter its appearance (e.g., reflective, transparent, or partially reflective/transparent) to reveal patterns of light via the underlying light source 120.

Functional control of segments of the first and second electrochemical films 115, 116 (e.g., turning on/off or dimming) may be matched to occur in a coordinated manner via controller 350. Alternatively, matching segments of films 115, 116 may be wired together using the same electrical lead such that supply of current/voltage for functional control is inherently matched for each segment of the pair. This arrangement has the added benefit of halving the total number of electrical leads needed for controlling segmented switchable lens 110.

System 300 of FIG. 3 enables lamp assembly 100 to provide automotive lighting functions (e.g., low/high-beam headlight functions, ADB functions, stop/turn signals, etc.) or custom appearances (e.g., stylistic features or lighting) while also providing an ability to conceal features of the lamp assembly 100 in a non-activated (e.g., opaque) mode.

Communication between user interface 360, controller 350, other vehicle subsystems 370, and lamp assembly 100 may be by a wired and/or wireless communication media. For example, controller 350 may include a transmitter/receiver, a multi-channel input/output (I/O) data bus, or the like (not shown) for communicatively coupling with user interface 360 and lamp assembly 100. The controller 350 is programmed with instructions for sending signals to the electrochemical films 115, 116 for switching individual segments 141-164 of segmented switchable lens 110, between active (e.g., substantially transparent), partially active (e.g., semi-transparent), and non-active (e.g., substantially opaque) modes. Other electronics known to those of skill in the art may be used in conjunction with the controller 350 for switching the modes and for providing PWM without departing from the scope hereof. The controller 350 may also be programmed with instructions for controlling one or more lights of light source 120 in coordination with corresponding segments 141-164. The programmed instructions may be predetermined and/or responsive to inputs from the user interface 360 or other vehicle subsystems 370.

In operation, the active mode occurs when an electric potential is applied to segments 141-164 of lens 110, and the non-active mode occurs when the electric potential is switched off. In the active mode, a high voltage and a low current are applied causing suspended particles to become charged such that the particles align in a particular orientation based on the electric potential across a corresponding segment of electrochemical films 115, 116. When a segment of films 115, 116 is switched on, the applied voltage/current electrically charges that segment like a charged capacitor. The suspended particles align such that light is allowed to pass making an active segment of films 115, 116 substantially transparent, similar to a glass window. When all segments of films 115, 116 are switched to the active mode becoming substantially transparent, lens 110 functions like a typical lens allowing light to pass and appears like a typical lens of a typical lamp assembly. When individual segments of films 115, 116 are switched to the inactive mode, the corresponding segments of lens 110 become substantially opaque enabling their use to block a portion of light from light source 120. For example, portions of a light source may be blocked to mitigate glare perceived by pedestrians or drivers in oncoming vehicles (e.g., for providing an ADB function).

In certain embodiments, segmented switchable lens 110 attains between about 80% to about 90% transparency when all segments are activated, meaning that about 80% to about 90% of light directed to lens 110 passes through lens 110. In some embodiments, lens 110 attains about 87% transparency when all segments are activated, which is lower than a standard lens (e.g., a standard lens normally has between about 90% to about 93% transparency). However, the optics of the lens 110 are not affected by the decreased transparency, and an increase in light output from light source 120 may be used to compensate for the decreased transparency.

In the absence of an applied electric potential, the suspended particles remain unorganized, and their random orientation blocks, absorbs, and/or reflects light. When all segments of films 115, 116 are inactivated, lens 110 is substantially opaque, which hides from view the inner workings of lamp assembly 100.

In certain embodiments, the suspended particles are highly reflective such that when unorganized in the non-active mode, lens 110 substantially reflects light in such a way as to have an appearance of a reflective mirror-like surface. The mirrored reflectiveness of the lens 110 may be adapted to provide a sleek and streamlined appearance that hides the unattractive functional appearance of a typical lamp assembly. The segmented switchable lens 110 may be used to completely hide, partially hide, or completely reveal anything disposed behind the lens 110 when segments of electrochemical films 115, 116 are completely non-active, partially active, or completely active, respectively.

Segmented switchable lens 110 may be molded to include curvature, contoured portions, grooves, textured surfaces, and other features, which may correspond to inner workings of a lamp assembly, such as light sources, etc. (e.g., low-beam and high-beam light sources of a headlamp). The electrochemical films 115, 116 may be applied to substrates in such a way as to accommodate curvature and other features molded into lens 110. An exemplary switchable-mirror lens assembly is described in pending U.S. application Ser. No. 15/931,824, entitled Switchable-Mirror Lens Assembly, and filed on May 14, 2020, the entirety of which is herein incorporated by reference.

By selectively activating individual segments 141-164 of segmented switchable lens 110, lamp assembly 100 is able to provide an ADB headlamp function that adaptively dims or turns off portions of a headlamp while driving for the purpose of reducing glare as perceived by someone outside the vehicle (e.g., a pedestrian or occupant of another vehicle). In certain embodiments, light source 120 is adapted for producing a high-beam function of a vehicle headlamp and lens 110 is disposed in front of the high-beam light source. By controlling some segments of segmented switchable lens 110 to be in the active mode and other segments to be in the inactive mode, an amount of light emitted from lamp assembly 100 may be varied (e.g., from a full high-beam state down to a legal low-beam state). Therefore, segmented switchable lens 110 may be used to protect oncoming traffic or pedestrians from glare by rapidly shuttering any portion of high-beam light that would otherwise cause glare to the oncoming traffic. Similarly, segments of segmented switchable lens 110 may be rapidly switched to alternate between active and inactive modes (e.g., using PWM), under control of the controller, thereby reducing an amount of light emitted from any segment.

The controller 350 of FIG. 3 may be used to determine which segments to activate or inactivate based on information received from sensors and other vehicle subsystems 370. For example, a camera subsystem may be used with a vehicle to image a forward view, and the controller may be used to determine which segments of films 115, 116 to turn off in real-time or near real-time to control light projected on a target location based on images received from the camera. The switching speed of the electrochemical film segments may be less than or about one-hundred milliseconds at 22° C. The controller may dim emitted light (e.g., via PWM) based on information received from the camera images. In addition to a camera, a GPS module may be used for determining a location of the vehicle and providing location information to the controller. In certain embodiments, radar information (e.g., from a radar transceiver onboard the vehicle) may also be used by the controller to determine target locations for determining which LEDs to turn off or modulate.

Segments 141-164, shown in FIG. 2, may be used collectively to project a beam pattern in front of a vehicle. Because each of LEDs 120A-120D and each of segments 141-164 are addressable, dimming (e.g., via PWM) or turning off individual LEDs and/or individual segments 141-164 enables rapid adjustments to the beam pattern for preventing glare as perceived by other vehicle occupants or pedestrians. The segments 141-164 of light assembly 100 may be activated/inactivated dynamically, under control of controller 350, to avoid producing glare at a target (e.g., another vehicle) while the target is moving relative to light assembly 100.

In addition to glare reduction, the direction of light emitted from a vehicle ADB headlamp may be adaptively changed by controlling segments 141-164. For example, while the vehicle is turning, controller 350 may determine a degree by which the vehicle is turning (e.g., via rotation sensors at the steering column as part of other vehicle subsystems 370) and selectively activate individual segments 141-164 to emit portions of light from light source 120 directed towards the direction of the turn. At the same time, controller 350 may block or dim portions of light from light source 120 by selectively inactivating or pulse-width modulating individual segments 141-164 directed away from the direction of the turn. Control of segments 141-164 enables the emitted beam pattern to shift or swivel without requiring any moveable components or a motor. For example, a hot spot of the beam (e.g., a brighter portion of the beam) may be moved in coordination with turning of the vehicle. Control of the beam pattern via segments 141-164 may be independent of, or in coordination with, control of individual LEDs (e.g., LEDs 120A-120D) of light source 120.

The number of segments and LEDs, the arrangement of segments and LEDs, and the shape and arrangement of inner lens 130 may be varied based on the illumination requirements of lamp assembly 100 and the luminance provided by the individual LEDs, among other things. Since a higher number of segments increases the resolution capability for adaptable light shaping, segmented switchable lens 110 provides a higher resolution in the horizontal direction by having twelve segments (e.g., 141-152), whereas a lower resolution is provided in the vertical direction due to only having two rows of segments. Other arrangements of segments, and the size, shape, and aspect ratio of the segments may be configured to achieve different lighting objectives (see e.g., FIG. 12).

The segments of segmented switchable lens 110 may have variable geometries, such as a variable width (also known as the "pitch"). This provides different exit areas for light to be emitted among lenses of differing width. For example, as depicted in FIG. 2, inner segments positioned near the middle of lens 110 (e.g., segments 144-149 and 156-161) are narrower than those towards the periphery (e.g., segments 141-143, 150-152, 153-155 and 162-164). Varying the pitch of the segments may be used to customize the light pattern. Narrower segments in the middle portion may be used to provide a higher resolution in the corresponding middle portion of a headlight beam to illuminate oncoming traffic, whereas a coarser resolution may be used on the periphery where passing traffic is closer to the vehicle and moving faster relative to the vehicle. Other variations in the inner segments 141-164, including variable aspect ratios and variable heights in the vertical direction are possible, without departing from the scope hereof. See e.g., FIGS. 9 and 12 and their description below.

Advantages of using segmented switchable lens 110 are that it replaces a mechanical shutter and reduces the number of LEDs needed for providing a functional ADB headlamp module. A reduction in the number of LEDs importantly corresponds with a reduction in the size of a heat sink or other means needed to remove heat from the lamp assembly.

By using segmented switchable lens 110 in combination with an ADB matrix of inner lenses for inner lens 130, greater control may be provided for shaping emitted light compared to a conventional ADB headlamp while requiring a smaller number of inner lenses and a smaller number of LEDs. In other words, the number of LEDs and corresponding inner lenses may be reduced without a corresponding decrease in the resolution of the adaptable light shaping capability.

Figure 4:
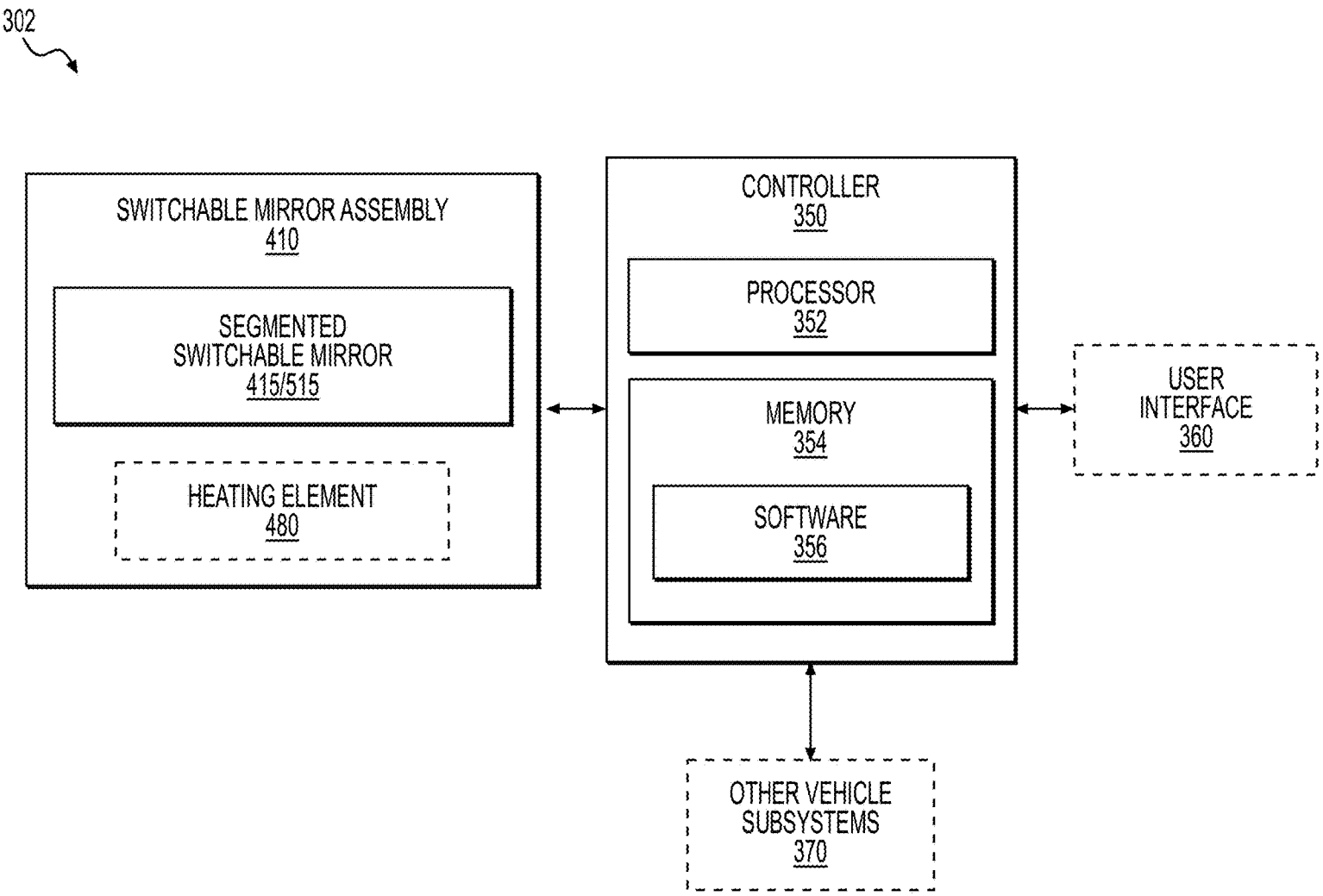
FIG. 4 is a block diagram showing components of an exemplary system for controlling the lamp assembly of FIGS. 5-12, in an embodiment.

FIG. 4 is a block diagram showing components of an exemplary vehicle lamp control system 302 for controlling an ADB vehicle headlamp assembly 400 having a switchable mirror assembly 410. System 302 is an example of system 300 of FIG. 3 with many of the same features. Items enumerated with like numerals are the same or similar and their description may not be repeated accordingly. System 302 is configured to provide control of components of switchable mirror assembly 410 via controller 350. Controller 350 is communicatively coupled with components of switchable mirror assembly 410, as well as optional user interface 360 and other vehicle subsystems 370. Features of controller 350, user interface 360, and other vehicle subsystems 370, as well as how they are communicatively coupled with one another, are described above in connection with FIG. 3.

Switchable mirror assembly 410 includes a segmented switchable mirror 415 configured with a pair of segmented electrochemical films to provide individually controllable mirror segments that are switchable between transparent and reflective states. The segmented electrochemical films are examples of electrochemical films 115, 116 described above in connection with FIGS. 1-3. Optionally, a heating element 480, which is an example of heating element 180 of FIGS. 1 and 3, may be provided with switchable mirror assembly 410 for maintaining a predetermined minimum temperature (e.g., −40° C.) to maintain proper function of the electrochemical films. Switchable mirror assembly 410 is further described below in connection with FIGS. 5-14.

FIG. 5 is a side view of ADB vehicle headlamp assembly 400. A collimated light source 405 directs beams of collimated light at segmented switchable mirror 415. When segments of mirror 415 are switched off to the reflective state, light is reflected off of those segments towards an inner lens 420, as depicted in FIG. 5. Inner lens 420, which is an example of inner lens 130 of FIG. 1, redirects the light to an outer lens 430 for projection from the ADB vehicle headlamp assembly 400. When segments of mirror 415 are switched on to the activated transparent state, light passes directly through those segments of mirror 415 (not shown), such that the portions of light corresponding with the transparent segments is not reflected for projection from the ADB vehicle headlamp assembly 400.

Figure 6:
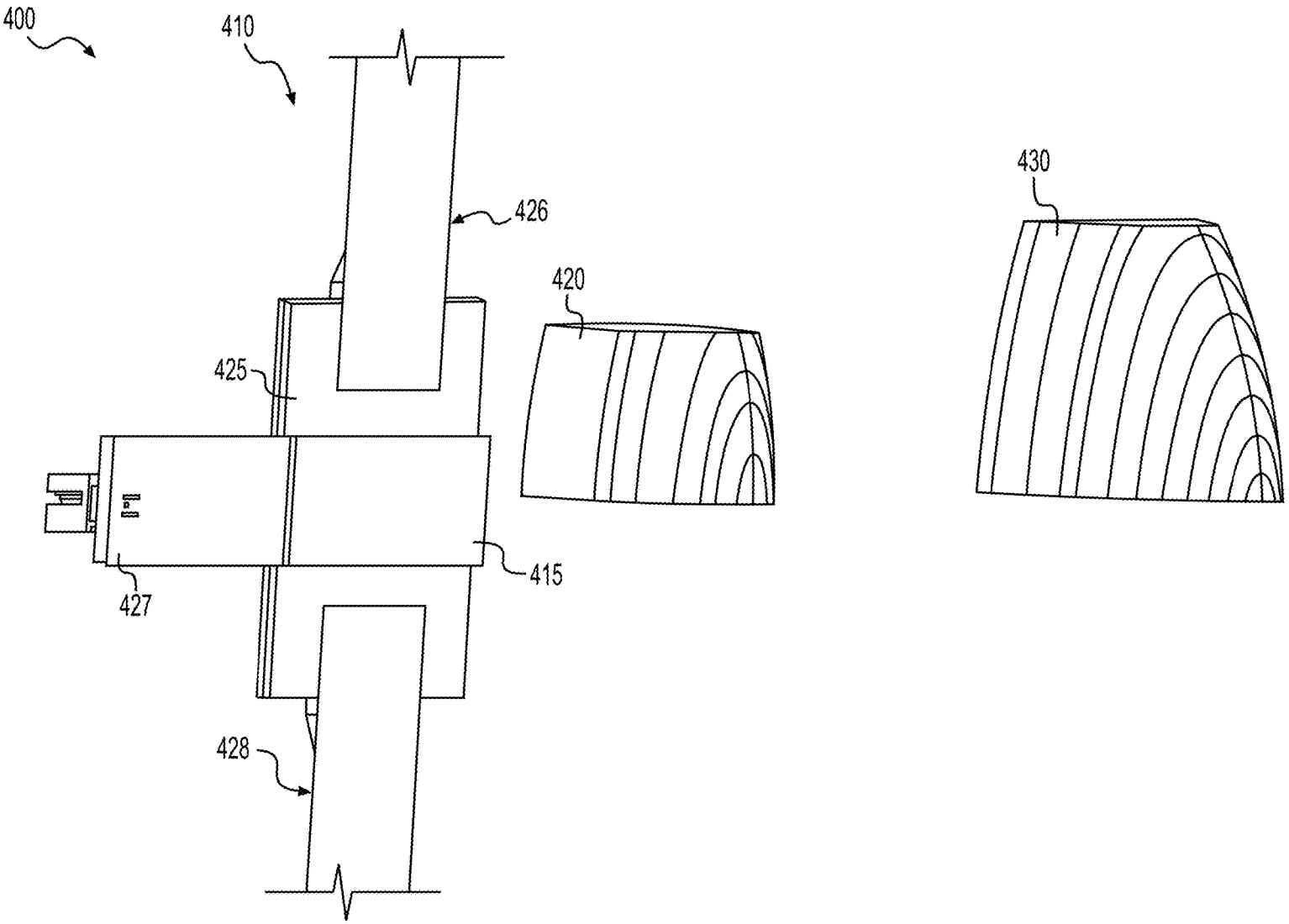
FIG. 6 is a perspective view of the ADB vehicle headlamp assembly of FIG. 5.
Figure 7:
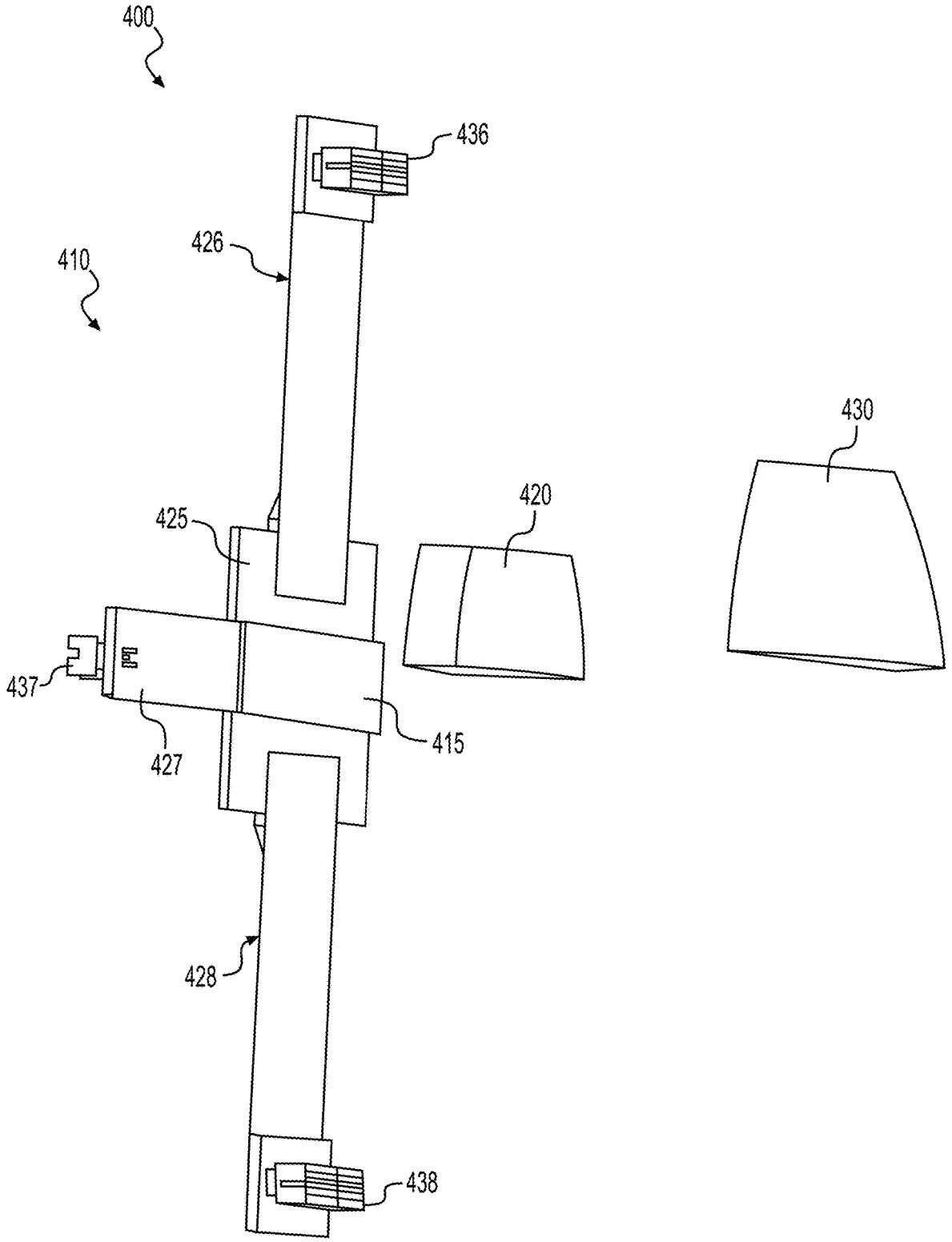
FIG. 7 is another perspective view of the ADB vehicle headlamp assembly of FIG. 5.
Figure 8:
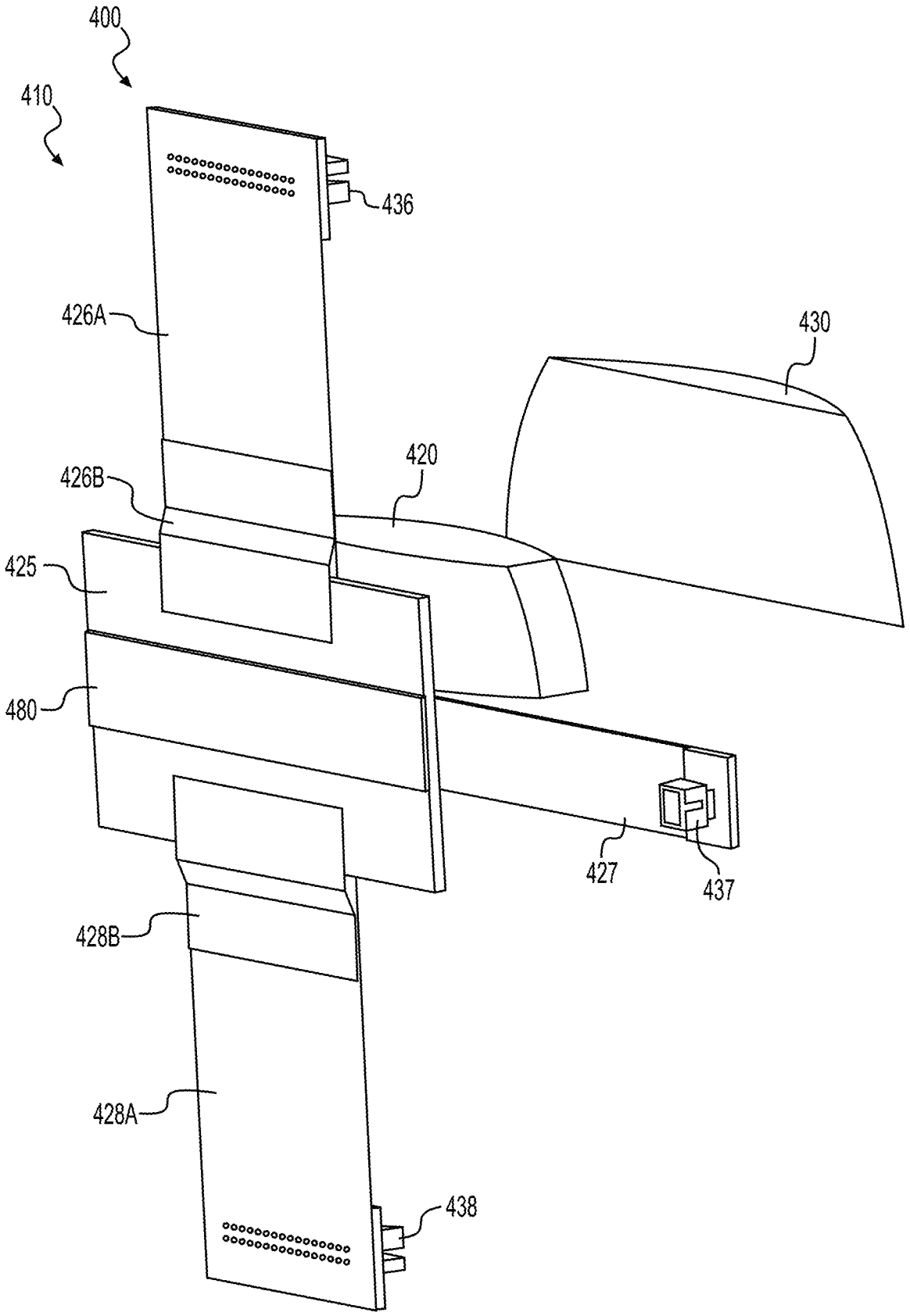
FIG. 8 is another perspective view of the ADB vehicle headlamp assembly of FIG. 5.

FIGS. 6-8 are perspective views of ADB vehicle headlamp assembly 400 showing switchable mirror assembly 410 in relation to inner lens 420 and outer lens 430. Emitted light and light source 405 are not shown in FIGS. 6-8 for clarity of illustration. The perspective view of FIGS. 6 and 7 reveals a "frontside" of switchable mirror assembly 410 in which segmented switchable mirror 415 is viewable; the perspective view of FIG. 8 reveals a "backside" of switchable mirror assembly 410 in which segmented switchable mirror 415 is not viewable. As depicted in FIGS. 6-8, a first electrical connector 426 and a second electrical connector 428 provide electrical leads to each of the electrochemical film segments of segmented switchable mirror 415. A third electrical connector 427 provides electrical leads to heating element 480 for heating of mirror 415. A transparent member 425 provides support for the electrical leads to be connected to mirror 415. Transparent member 425 is made of clear plastic or glass enabling light to pass.

FIG. 7 shows electrical plug receptacles 436, 437, and 438 electrically and mechanically connected with a respective one of the electrical connectors 426, 427, and 428. Specifically, a first electrical plug receptacle 436 is a multi-pin receptacle configured for plugging in to a multi-channel electrical power supply for individually supplying current/voltage to individual segments of segmented switchable mirror 415. Similarly, a second electrical plug receptacle 437 is a multi-pin receptacle configured for plugging in to a multi-channel electrical power supply for individually supplying current/voltage to individual segments of segmented switchable mirror 415. For example, first and second electrical plug receptacles 436, 437 are 30-pin receptacles each providing connection to thirty independent electrical leads, where each electrical lead is used to supply current/voltage for controlling at least one switchable mirror segment of mirror 415. A third electrical plug receptacle 437 is a receptacle configured for plugging in to an electrical power supply for supplying current/voltage to a heating element (e.g., heating element 480, described below in connection with FIGS. 8 and 10).

FIG. 8 shows the backside of switchable mirror assembly 410 in which an optional heating element 480 is disposed adjacent transparent member 425 in a thermally conductive manner adapted for heating segmented switchable mirror 415. However, other means of heating segmented switchable mirror 415 known to those of skill in the art are possible without departing from the scope hereof. Also viewable from FIG. 8 are multi-channel leads electrically connecting first and second electrical connectors 426, 428 to segmented switchable mirror 415. For example, first electrical connector 426 includes a first side 426A that provides a plurality of leads to the frontside of segmented switchable mirror 415 and a second side 426B that provides a plurality of leads to the backside of mirror 415. In embodiments, these electrical leads may be connected to a top row of segments (e.g., 415A and the segments to its right in FIG. 9). Similarly, second electrical connector 428 includes a first side 428A that provides a plurality of leads to the frontside of segmented switchable mirror 415 and a second side 428B that provides a plurality of leads to the backside of mirror 415. In embodiments, these electrical leads may be connected to a bottom row of segments (e.g., 415B and the segments to its right in FIG. 9). In this way half of the electrical leads are provided from the frontside, and the other half are provided from the backside, making management of the wiring to the individual segments feasible. The second side connectors 426B, 428B are for example flex circuits that provide flexible multi-lead electrical connectors for electrically connecting segments from the backside of mirror 415.

Figure 9:
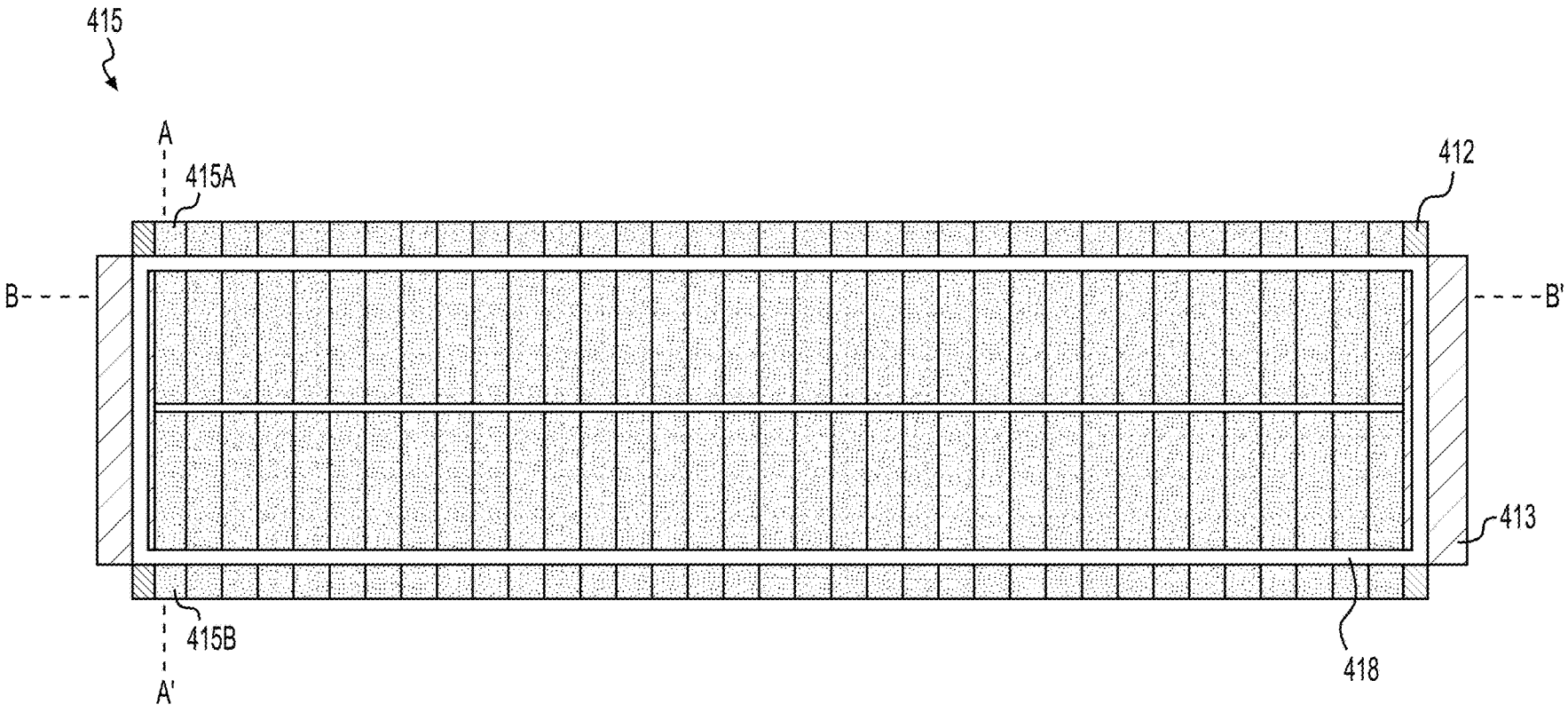
FIG. 9 is a cross-sectional top-down view of a segmented switchable mirror, in an embodiment.

FIG. 9 is a cross-sectional top-down view of segmented switchable mirror 415. A plurality of segments of mirror 415 are shown arranged in two arrays. As labeled in FIG. 9, a first array of switchable mirror segments includes a first mirror segment 415A and a second array includes a second mirror segment 415B. Not all mirror segments are enumerated for clarity of illustration. In certain embodiments, the first array of mirror segments is used for adaptively controlling a low-beam output of a vehicle headlamp, and the second array of mirror segments is used for adaptively controlling a high-beam output of a vehicle headlamp. The number, size, shape, aspect ratio, and layout of the mirror segments within each array may be varied to provide custom adaptively controlled light outputs (see e.g., FIG. 12). Likewise, the number and arrangement of arrays of mirror segments may be varied to provide custom adaptively controlled light outputs, including for example different polarizations of light output (see e.g., FIGS. 10-11).

A first seal 418 is disposed along a top side of the mirror segments. Functional portions of the mirror segments are within the first seal 418, and electrical connections to electrical leads are disposed outside of the first seal 418 (e.g., along the periphery of segmented switchable mirror 415). In other words, the electrical connections are made to the top portion of each segment in the top row (e.g., first mirror segment 415A) and to the bottom portion of each segment in the bottom row (e.g., second mirror segment 415B), outside the perimeter of first seal 418. First seal 418 is for example a silicone sealing material providing a barrier that prevents debris from entering to maintain clean mirror segments and for mitigating oxidation of the mirror segments. A second substrate 412 and a third substrate 413 are best viewed in FIG. 10. The substrates 412, 413 are for example optically clear glass or plastic (e.g., polycarbonate or acrylic) that provide transparent surfaces for disposing switchable mirror segments or electrical leads thereon as further described below. The line denoted A-A' indicates the location of a transverse cross-section shown in FIG. 10. The line denoted as B-B' indicates the location of a longitudinal cross-section shown in FIG. 11.

In operation, ADB vehicle headlamp assembly 400, under control of controller 350, may be used with segmented switchable mirror 415 to produce spot images or images having gaps or dark spots in which a portion of the light distribution image is not illuminated (not shown), thereby reducing glare at a target location. Exemplary spot images and images having gaps are shown in pending U.S. application Ser. No. 16/561,673, entitled Programmable Glare-Free High Beam and filed on Sep. 5, 2019, the entirety of which is herein incorporated by reference.

A camera subsystem may be used to image a vehicle's forward view, and controller 350 of FIG. 4 may be used to determine which segments of segmented switchable mirror 415 to turn off in real-time or near real-time to control light projected on a target location based on images received from the camera. Controller 350 may dim emitted light (e.g., via PWM) based on information received from the camera images. In addition to a camera, a GPS module may be used for determining a location of the vehicle and providing location information to the controller. In certain embodiments, radar information (e.g., from a radar transceiver onboard the vehicle) may also be used by controller 350 to determine target locations for determining which segments of segmented switchable mirror 415 to activate for making transparent, and thus not propagate light, for reducing glare at the target location.

In addition to providing high/low-beam light distributions and dynamic glare reduction, a direction of light emitted from a vehicle ADB headlamp may be adaptively changed by controlling segments of segmented switchable mirror 415. For example, while the vehicle is turning, controller 350 of FIG. 4 may determine a degree by which the vehicle is turning (e.g., via rotation sensors at the steering column as part of other vehicle subsystems 370) and selectively activate individual segments to emit portions of light directed towards the direction of the turn. At the same time, controller 350 may block or dim portions of light by selectively inactivating or pulse-width modulating individual segments directed away from the direction of the turn. Control of segments of segmented switchable mirror 415 enables the emitted beam pattern to shift or swivel without requiring any moveable components or a motor. For example, a hot spot of the beam may be moved in coordination with turning of the vehicle.

Unlike a digital micro-mirror device (DMD), such as the DMD described in the above referenced U.S. application Ser. No. 16/561,673, in which individual mirrors pivot between positions for reflecting light in different directions, no moving parts are needed for segmented switchable mirror 415 to alter light output. Also, all of the individual DMD mirrors are of the same size, shape, and aspect ratio, whereas segmented switchable mirror 415 is easily configured with variable and customizable sizes, shapes, and aspect ratios of the individual segments (see e.g., switchable mirror array 515 of FIG. 12).

Figure 10:
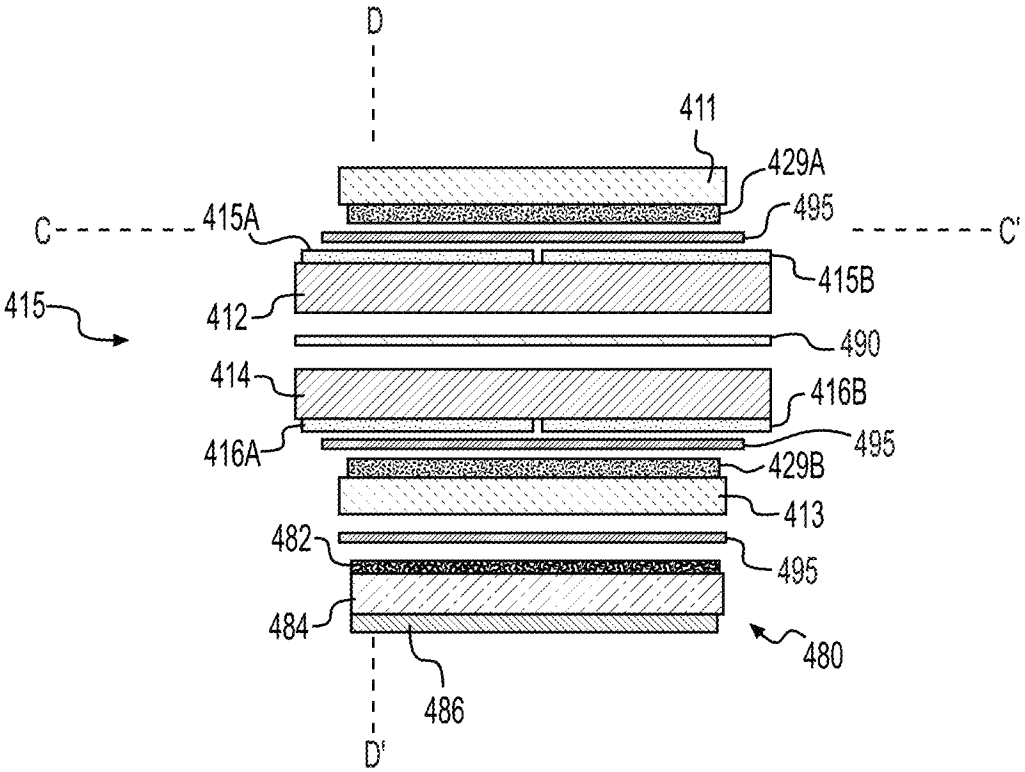
FIG. 10 is a transverse cross-sectional exploded view of the segmented switchable mirror of FIG. 9 and of an optional heating element, in an embodiment.

FIG. 10 is a transverse cross-sectional exploded view of segmented switchable mirror 415 and optional heating element 480. The view of FIG. 10 corresponds with the line denoted as A-A' in FIG. 9 and the line denoted as F-F' in FIG. 11. The line denoted as C-C' in FIG. 10 corresponds with the top-down cross-sectional view shown in FIG. 9, and the line denoted as D-D' corresponds with the longitudinal cross-sectional view shown in FIG. 11. Seals may be disposed around portions of the mirror segments, such as first seal 418 depicted in FIGS. 9 and 11 and a second seal 419 depicted in FIG. 11; however, these are not shown in FIG. 10 for clarity of illustration.

Figure 11:
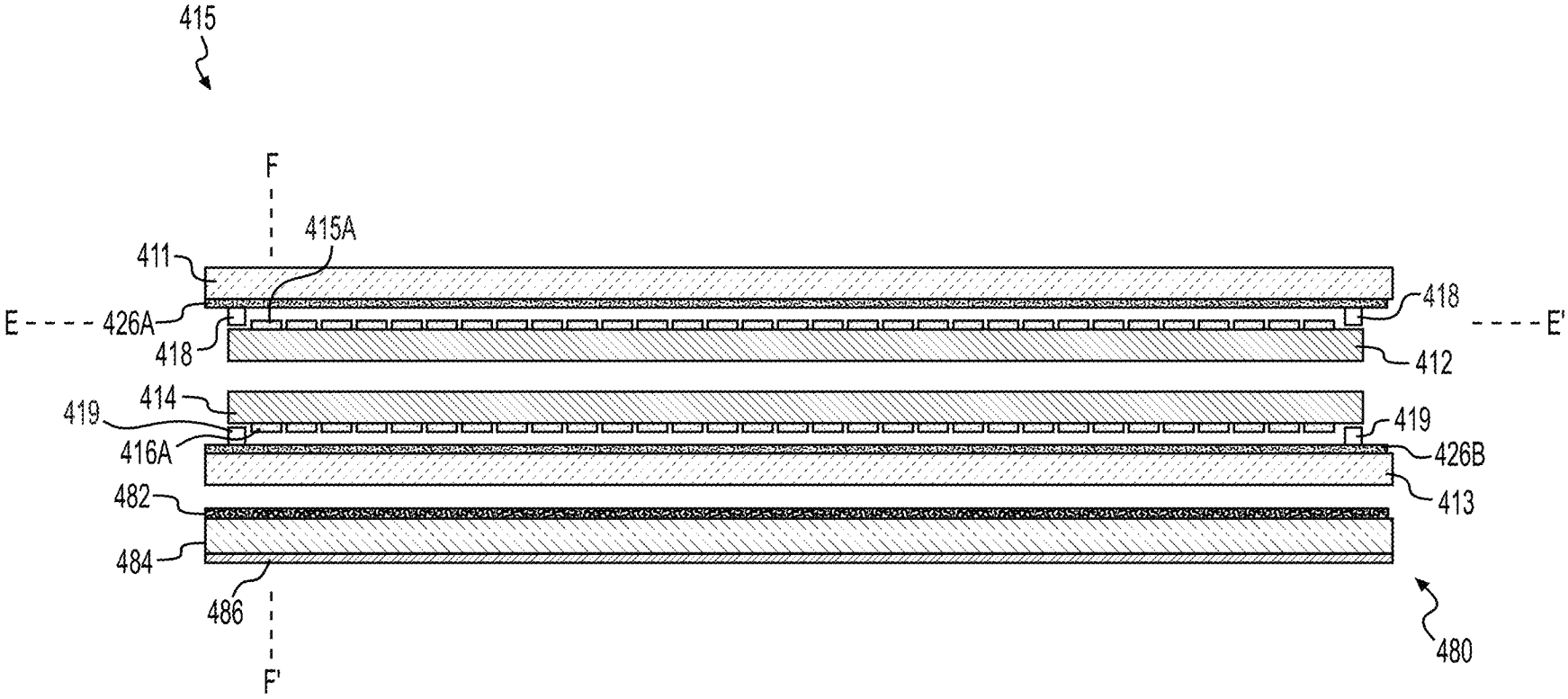
FIG. 11 is a longitudinal cross-sectional exploded view of the segmented switchable mirror of FIGS. 9 and 10 and of the optional heating element of FIG. 10, in an embodiment.

In the exploded views of FIGS. 10 and 11, some components of segmented switchable mirror 415 are shown as separated for clarity of illustration; however, the components may be closer together or bonded together with optically clear adhesive to provide a functioning switchable mirror as further described below. FIGS. 10 and 11 are best viewed together with the following description.

A first substrate 411 has a first common ground 429A disposed thereon for electrically grounding the electrochemical circuits of the plurality of switchable mirror segments. A second substrate 412 has a plurality of switchable mirror segments disposed thereon, including first mirror segment 415A and second mirror segment 415B as shown in FIG. 10. An optically clear electrical isolating film 495 is disposed between the first common ground 429A and the switchable mirror segments 415A, 415B. Individual electrical leads (not shown) connect to the peripheral edges of the switchable mirror segments 415A, 415B and first common ground 429A to provide individually controllable electrical current/voltage, as described above in connection with FIG. 9.

In the embodiment depicted in FIGS. 10 and 11, segmented switchable mirror 415 includes two sets of switchable-mirror arrays that are optically aligned with one another. As shown in FIG. 10, a third substrate 413 is an example of first substrate 411 in which a second common ground 429B is disposed thereon. Similarly, a fourth substrate 414 is an example of second substrate 412 having a plurality of switchable mirror segments disposed thereon, including a third mirror segment 416A and a fourth mirror segment 416B. An optically clear electrical isolating film 495 is disposed between the second common ground 429B and the switchable mirror segments 416A, 416B. Individual electrical leads (not shown) connect to the peripheral edges of the switchable mirror segments 416A, 416B and second common ground 429B to provide individually controllable electrical current/voltage, as described above in connection with FIG. 9. Second and fourth substrates 412, 414 may be held together using an optically clear adhesive 490. In certain embodiments, all of the substrates may be held together using an optically clear adhesive (not shown).

The two sets of switchable mirror arrays of segments are used to provide different polarizations of light. For example, first mirror segment 415A and second mirror segment 415B may be configured to provide a left-hand light polarization, whereas third mirror segment 416A and fourth mirror segment 416B may be configured to provide a right-hand light polarization. By having two sets of switchable mirror arrays optically aligned with one another, light transmitted from segmented switchable mirror 415 is polarized in both clockwise and counter-clockwise directions. Individual mirror segments may be controlled in pairs based on polarization. In other words, each segment from the top set is paired with a matching segment from the bottom set, and the pair of segments are controlled together. For example, functional control of the first and third mirror segments 415A and 416A (e.g., turning on/off or dimming) may be matched to occur in a coordinated manner via controller 350. Alternatively, each of the paired segments (e.g., first mirror segment 415A and third mirror segment 416A) may be wired together using the same electrical lead such that supply of current/voltage for functional control is inherently matched for each segment of the pair. This arrangement has the added benefit of halving the total number of electrical leads needed for controlling segmented switchable mirror 415.

Heating element 480 is optionally disposed adjacent segmented switchable mirror 415. In the embodiment depicted in FIG. 10, heating element 480 includes a transparent conductive layer 482, which may be electrically powered to produce heat. Transparent conductive layer 482 is disposed on a fifth substrate 484, which is for example a layer of glass. Electrical power may be provided via third electrical connector 427 of FIGS. 6-8. Transparent conductive layer 482 is for example a thin film layer of indium tin oxide (ITO), which provides a transparent resistor. Alternatively, transparent conductive layer uses silver nanowires to provide a transparent resistor. Other heating elements and transparent conductive layers may be used without departing from the scope hereof. Heating element 480 may be used to maintain a predetermined minimum temperature of the segmented switchable mirror 415 (e.g., −40° C.) to maintain proper function of the electrochemical films. An anti-reflection coating 486 may be disposed on fifth substrate 484, opposite transparent conductive layer 482.

FIG. 11 is a longitudinal cross-sectional exploded view of segmented switchable mirror 415 and optional heating element 480. The view of FIG. 11 corresponds with the line denoted as B-B' in FIG. 9 and the line denoted as D-D' in FIG. 10. The line denoted as E-E' in FIG. 11 corresponds with the top-down cross-sectional view shown in FIG. 9, and the line denoted as F-F' corresponds with the transverse cross-sectional view shown in FIG. 10. First seal 418 provides a seal to protect the upper mirror array (e.g., including first mirror segment 415A) and second seal 419 provides a seal to protect the lower mirror array (e.g., including third mirror segment 416A). The optically clear adhesive 490 and the optically clear electrical isolating films 495 are not depicted in FIG. 11 for clarity of illustration.

Figure 12:
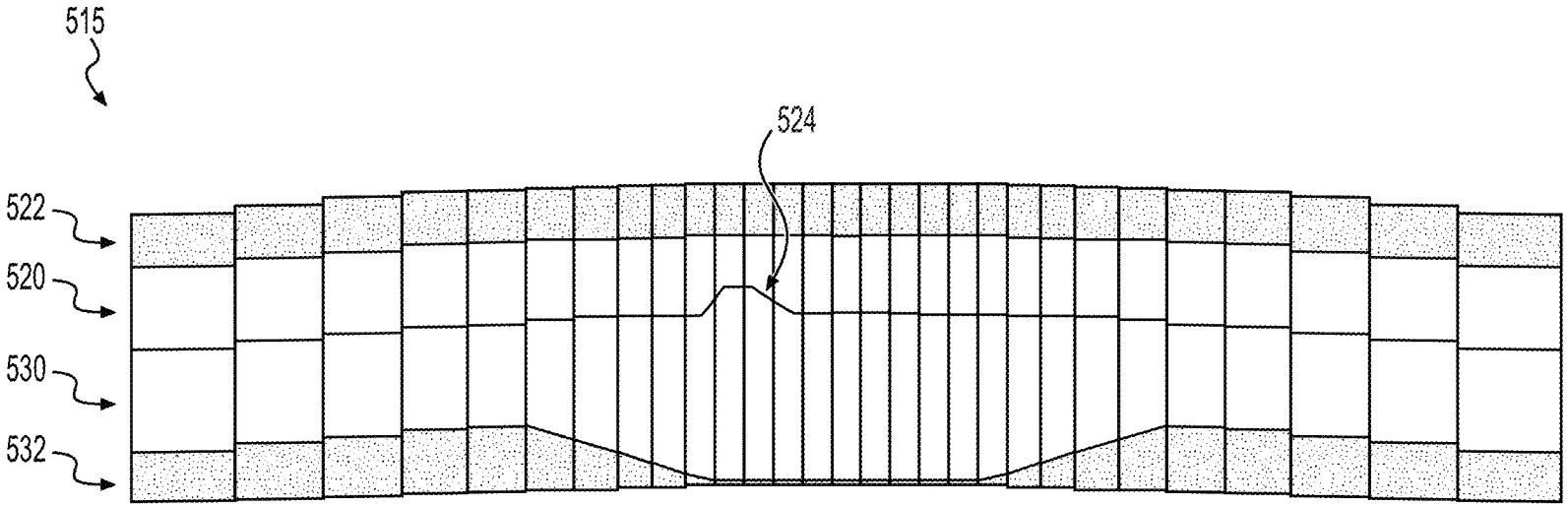
FIG. 12 shows a segmented switchable mirror array customized for providing a low-beam and a high-beam light output from a vehicle headlamp, in an embodiment.

FIG. 12 shows an exemplary segmented switchable mirror array 515 customized for providing a low-beam and a high-beam light output from a vehicle headlamp. The switchable mirror array 515 includes a segmented electrochemical film wired for providing individually controllable mirror segments that are switchable between an active transparent state and a non-active reflective state. Switchable mirror array 515 is an example of segmented switchable mirror 415 of FIGS. 9-11 in which the individual segments are likewise arranged to form two arrays, one for producing a low-beam light distribution and the other for producing a high-beam light distribution of a vehicle headlamp; however, switchable mirror array 515 is configured with segments formed of various sizes, shapes and aspect ratios as further descried below.

A low-beam switchable-mirror segment array 520 includes individually controllable segments of the electrochemical film having wider segments towards the periphery and narrower segments towards the center. A multi-segment notch 524 is provided in a portion of segments of array 520 to provide a legal antiglare cutoff point 624 in the low-beam light distribution (see FIG. 13). A non-functional portion 522 of array 520 provides a location for connection of electrical leads on each of the mirror segments. The non-functional portion 522 may be prevented from functioning as a mirror so as to not redirect light (e.g., as depicted in FIG. 5). For example, the non-functional portion 522 may be coated with a non-transparent coating or material (e.g., flat-black paint) so as to be substantially opaque.

A high-beam switchable-mirror segment array 530 also includes individually controllable segments of the electrochemical film having various sizes, shapes and aspect ratios, and arranged in a non-linear array. As depicted in FIG. 12, the multi-segment notch 524 from low-beam switchable-mirror segment array 520 may be matched in high-beam switchable-mirror segment array 530 such that the legal antiglare cutoff point 624 in the low-beam light distribution (see FIG. 13) is filled in by the high-beam light distribution (see FIG. 14). A non-functional portion 532 is similar to non-functional portion 522 for providing a location for electrical connections to each of the mirror segments without functioning as a mirror for redirecting light.

Alternatively, switchable mirror array 515 is configured for using both switchable mirror segment arrays 520, 530 to provide ADB low-beam functions, and the high-beam (e.g., a standard high-beam) is provided separately. Another option is to provide only one array for ADB functionality, e.g., low-beam switchable-mirror segment array 520, and have the other beam (e.g., the high-beam) provided separately.

Figure 13:
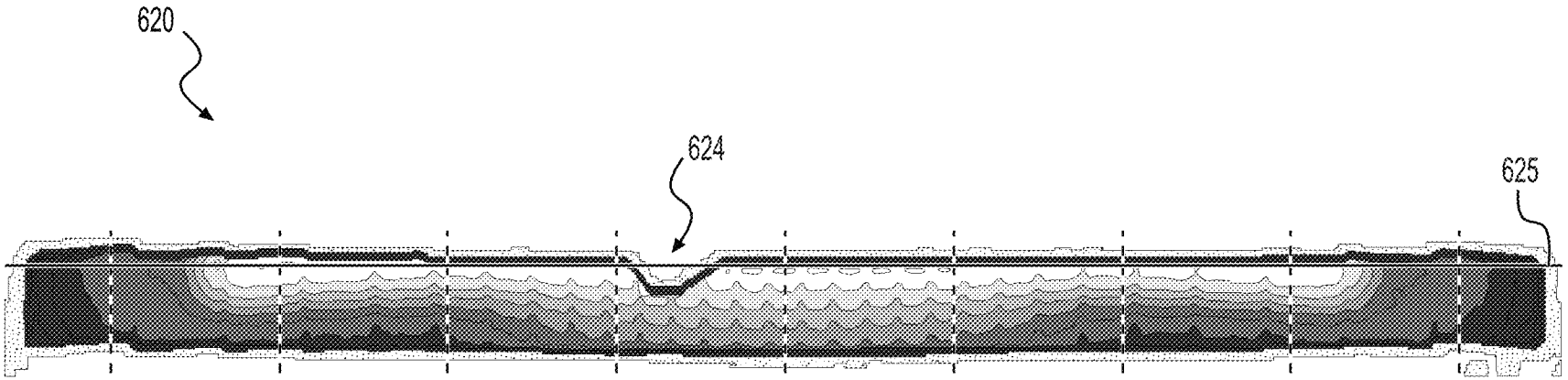
FIG. 13 is a contour plot of an exemplary low-beam light distribution image, in an embodiment.

FIG. 13 is a contour plot 620 of an exemplary low-beam light distribution image. To generate the low-beam light distribution image represented by contour plot 620, segmented switchable mirror array 515 of FIG. 12 is operated (e.g., via controller 350 of FIG. 4) with low-beam switchable-mirror segment array 520 inactivated to provide the reflective state in all the mirror segments of array 520, and high-beam switchable-mirror segment array 530 is activated to provide the transparent state in all of the mirror segments of array 530, such that only low-beam light is projected from ADB vehicle headlamp assembly 400. Light directed to switchable mirror array 515 passes through the transparent segments of array 530, including at multi-segment notch 524, such that the corresponding high-beam portion of light is not redirected towards inner lens 420 and outer lens 430 as in FIG. 5. Instead the light which passes through transparent segments of high-beam switchable-mirror segment array 530 is directed to an absorber (not shown) or redirected to some other location such that the light is not projected from ADB vehicle headlamp assembly 400. Note that legal antiglare cutoff point 624 is also devoid of light in FIG. 13. A low-beam cutoff line 625 is shown on contour plot 620 of FIG. 13 and contour plot 650 of FIG. 14 as a target reference location.

Figure 14:
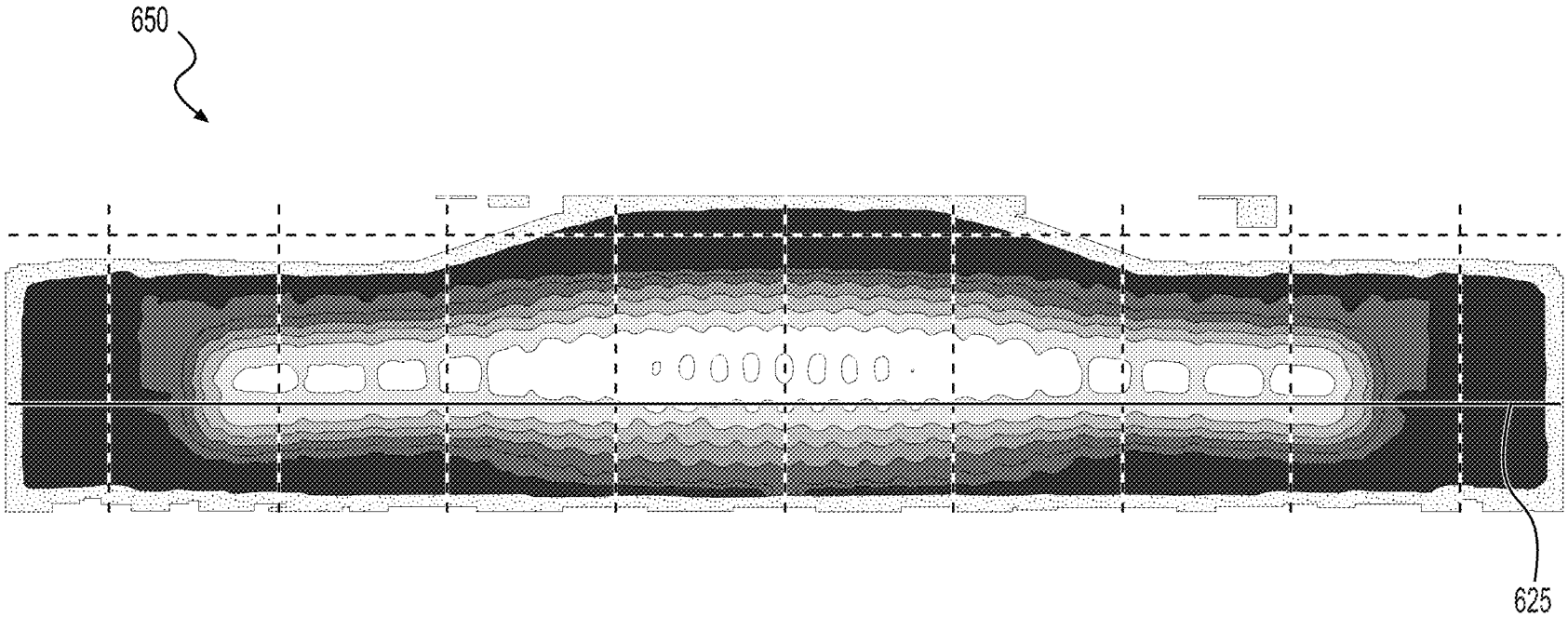
FIG. 14 is a contour plot of an exemplary combined high-beam and low-beam light distribution image, in an embodiment.

FIG. 14 is a contour plot 650 of an exemplary combined high-beam and low-beam light distribution image. To generate the light distribution image represented by contour plot 650, segmented switchable mirror array 515 is operated (e.g., via controller 350 of FIG. 4) with both low-beam switchable-mirror segment array 520 and high-beam switchable-mirror segment array 530 inactivated to provide the reflective state such that both low-beam and high-beam light is projected from ADB vehicle headlamp assembly 400. In other words, light is projected both above and below low-beam cutoff line 625.

In operation, ADB vehicle headlamp assembly 400, under control of controller 350, may be used with switchable mirror array 515 to produce spot images or images having gaps or dark spots in which a portion of the light distribution image is not illuminated (not shown) that are used to reduce glare at a target location. Exemplary spot images and images having gaps are shown in the above referenced U.S. application Ser. No. 16/561,673. A camera subsystem may be used to image a vehicle's forward view, and controller 350 of FIG. 4 may be used to determine which segments of switchable mirror array 515 to turn off in real-time or near real-time to control light projected on a target location based on images received from the camera. Controller 350 may dim emitted light (e.g., via PWM) based on information received from the camera images. In addition to a camera, a GPS module may be used for determining a location of the vehicle and providing location information to the controller. In certain embodiments, radar information (e.g., from a radar transceiver onboard the vehicle) may also be used by controller 350 to determine target locations for determining which segments of switchable mirror array 515 to activate for making transparent, and thus not propagate light, for reducing glare at the target location.

In addition to providing high/low-beam light distributions and dynamic glare reduction, a direction of light emitted from a vehicle ADB headlamp may be adaptively changed by controlling electrochemical film segments of switchable mirror array 515. For example, while the vehicle is turning, controller 350 of FIG. 4 may determine a degree by which the vehicle is turning (e.g., via rotation sensors at the steering column as part of other vehicle subsystems 370) and selectively activate individual segments to emit portions of light directed towards the direction of the turn. At the same time, controller 350 may block or dim portions of light by selectively inactivating or pulse-width modulating individual segments directed away from the direction of the turn. Control of segments switchable mirror array 515 enables the emitted beam pattern to shift or swivel without requiring any moveable components or a motor. For example, a hot spot of the beam may be moved in coordination with turning of the vehicle.

Unlike a digital micro-mirror device (DMD), such as the DMD described in the above referenced U.S. application Ser. No. 16/561,673, in which all of the individual mirrors are of the same size, shape, and aspect ratio, the size, shape, and aspect ratio of the segments of switchable mirror array 515 are variable and customizable. Also, unlike a DMD, no moving parts are needed for switchable mirror array 515 to alter light output.

Features described above as well as those claimed below may be combined in various ways without departing from the scope hereof. The following examples illustrate some possible, non-limiting combinations:

(A1) A segmented switchable mirror vehicle headlamp includes a light source, a switchable electrochemical film having a plurality of segments, and a controller electrically coupled with each segment of the plurality of segments, such that each segment of the plurality of segments is individually controllable for switching between a substantially transparent state and a substantially reflective state. The plurality of segments include a low-beam array of segments configured for providing a low-beam light distribution from the light source, and a high-beam array of segments configured for providing a high-beam light distribution from the light source. The controller is configured for switching the low-beam array of segments and the high-beam array of segments between the substantially transparent state and the substantially reflective state for controlling the low-beam light distribution and the high-beam light distribution, respectively.

(A2) For the segmented switchable mirror vehicle headlamp denoted as (A1), a camera subsystem for imaging a forward view from a vehicle may be provided, wherein the controller may be configured to determine: a) a target location based on images from the camera subsystem, and b) which segments of the plurality of segments to switch between substantially transparent and substantially reflective states for mitigating glare at the target location.

(A3) For the segmented switchable mirror vehicle headlamp denoted as (A1) or (A2), the controller may be configured to actively switch each segment of the plurality of segments between the substantially transparent state and the substantially reflective state in a coordinated manner for shifting a direction of light projected from the segmented switchable mirror vehicle headlamp without the use of any moveable components or a motor (A4) For the segmented switchable mirror vehicle headlamp denoted as any of (A1) through (A3), the controller may dim a portion of light projected from the segmented switchable mirror vehicle headlamp via pulse-width modulation of at least one segment of the plurality of segments.

(A5) For the segmented switchable mirror vehicle headlamp denoted as any of (A1) through (A4), the switchable electrochemical film may include a first layer that provides a polarization of light in a first direction, and a second layer, optically aligned with the first layer, that provides a polarization of light in a second direction, different from the first direction.

(B1) An adaptable-driving-beam headlamp for a vehicle includes a plurality of light-emitting diodes (LEDs) mounted on one or more printed circuit board, an inner lens aligned with the plurality of LEDs for shaping light emitted therefrom, an outer lens adapted to receive light from the inner lens and project the light from the vehicle, a camera system for imaging a forward view from the vehicle, and a controller adapted for determining a target location based on images received from the camera system. The outer lens includes a first transparent layer and a second transparent layer adjacent the first transparent layer, a switchable electrochemical film disposed between the first transparent layer and the second transparent layer, wherein the switchable electrochemical film includes a plurality of film segments. The plurality of film segments are each individually controllable via the controller such that each of the plurality of film segments is switchable between a substantially transparent state and a substantially opaque state for actively dimming a portion of light projected from the outer lens based on the target location.

(B2) For the adaptable-driving-beam headlamp for a vehicle denoted as (B1), the inner lens may include an assembly of sub-lenses, and each of the sub-lenses is aligned with a respective one of the plurality of LEDs for shaping light emitted therefrom.

(B3) For the adaptable-driving-beam headlamp for a vehicle denoted as (B1) or (B2), the plurality of film segments may be shaped to provide a high-beam cutoff, and the controller may control the plurality of film segments according to the high-beam cutoff, thereby switching between a low-beam pattern and a high-beam pattern of light projected from the outer lens.

(B4) For the adaptable-driving-beam headlamp for a vehicle denoted as any of (B1) through (B3), the beam pattern may be adaptively shifted by actively switching a transparency state of the plurality of film segments to swivel the direction of light projected from the outer lens without the use of any moveable components or a motor.

(B5) For the adaptable-driving-beam headlamp for a vehicle denoted as any of (B1) through (B4), the controller may dim a portion of light projected from the outer lens via pulse-width modulation of a portion of the plurality of film segments.

(C1) A switchable-mirror adaptable-driving-beam headlamp for a vehicle includes a switchable mirror having a plurality of electrochemical film segments, a controller electrically coupled with each segment of the plurality of electrochemical film segments, such that each segment is individually controllable for switching between a substantially transparent state and a substantially reflective state, and a collimated light source directed at the switchable mirror such that each segment in the substantially reflective state reflects light from the collimated light source for projecting from a vehicle headlamp, and each segment in the substantially transparent state does not reflect light from the collimated light source.

(C2) For the switchable-mirror adaptable-driving-beam headlamp for a vehicle denoted as (C1), a camera subsystem may be provided for imaging a forward view from the vehicle, wherein the controller may be configured to determine a target location based on images received from the camera subsystem, and the controller may control a portion of the plurality of electrochemical film segments to switch to the substantially transparent state thereby substantially dimming a corresponding portion of light.

(C3) For the switchable-mirror adaptable-driving-beam headlamp for a vehicle denoted as (C1) or (C2), the switchable mirror may be configured for producing a low-beam light distribution and a high-beam light distribution based on a size, shape, and arrangement of the plurality of electrochemical film segments, and the controller may be configured to control the plurality of electrochemical film segments for switching between the low-beam light distribution and the high-beam light distribution.

(C4) For the switchable-mirror adaptable-driving-beam headlamp for a vehicle denoted as any of (C1) through (C3), the controller may be configured to actively switch each segment between the substantially transparent state and the substantially reflective state in a coordinated manner to provide a hot spot in a light distribution and to shift a direction of the hot spot in coordination with turning of a vehicle.

(C5) For the switchable-mirror adaptable-driving-beam headlamp for a vehicle denoted as any of (C1) through (C4), a heating element may be provided having a transparent conductive layer electrically powered to produce heat for heating the switchable mirror.

Many different arrangements of the various components depicted, as well as components not shown, are possible without departing from the spirit and scope of the present disclosure. Embodiments of the present disclosure have been described with the intent to be illustrative rather than restrictive. Embodiments of the present disclosure have been described in the context of vehicle headlamps, but other uses and alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all operations listed in the various figures need be carried out in the specific order described.

The invention claimed is:

1. A segmented switchable mirror headlamp for a vehicle, comprising:

a light source;

a switchable electrochemical film having a plurality of segments, wherein each segment comprises a first layer that polarizes light in a first direction, and a second layer, optically aligned with the first layer, that polarizes light in a second direction, different from the first direction;

a controller electrically coupled with each segment of the plurality of segments, such that each segment of the plurality of segments is individually controllable for switching between a substantially transparent state and a substantially reflective state, and wherein electrical control of the first layer and the second layer of each segment is matched to occur in a coordinated manner;

the plurality of segments comprise a low-beam array of segments configured for providing a low-beam light distribution from the light source, and a high-beam array of segments configured for providing a high-beam light distribution from the light source; and the controller is configured for switching the low-beam array of segments and the high-beam array of segments between the substantially transparent state and the substantially reflective state for controlling the low-beam light distribution and the high-beam light distribution, respectively.

2. The segmented switchable mirror headlamp of claim 1, further comprising:

a sensing subsystem for sensing objects in front of the vehicle, wherein the controller is configured to determine:

a) a target location of the objects based on information received from the sensing subsystem; and b) which segments of the plurality of segments to switch between substantially transparent and substantially reflective states for mitigating glare at the target location.

3. The segmented switchable mirror headlamp of claim 1, wherein the controller is configured to actively switch each segment of the plurality of segments between the substantially transparent state and the substantially reflective state in a coordinated manner for shifting a direction of light projected from the segmented switchable mirror headlamp without using any moveable components or a motor.

4. The segmented switchable mirror headlamp of claim 1, wherein the controller controls a transparency of at least one segment of the plurality of segments via pulse-width modulation to provide a semi-transparent state for dimming a portion of light projected from the segmented switchable mirror headlamp.

5. The segmented switchable mirror headlamp of claim 1, wherein the controller is electrically coupled with each segment of the plurality of segments via a peripheral edge of each segment.

6. The segmented switchable mirror headlamp of claim 1, wherein the light source comprises a single light-emitting diode (LED).

7. An adaptable-driving-beam headlamp for a vehicle, comprising:

at least one light-emitting diode (LED);

a first lens aligned with the at least one LED for shaping light emitted therefrom;

a second lens adapted to receive light from the first lens and project a beam pattern of light from the vehicle;

a switchable electrochemical film disposed on a transparent substrate, the switchable electrochemical film having a plurality of film segments each being switchable between a substantially transparent state and a substantially opaque state;

a sensing subsystem for sensing objects forward of the vehicle; and a controller configured to determine a target location based on data received from the sensing subsystem, wherein the controller controls the at least one LED and the plurality of film segments of the switchable electrochemical film for actively dimming a portion of the beam pattern of light projected from the vehicle based on the target location.

8. The adaptable-driving-beam headlamp of claim 7, wherein the plurality of film segments of the switchable electrochemical film, under control of the controller, are configured for shaping the beam pattern of light projected from the vehicle by actively dimming or blocking portions of the beam pattern of light.

9. The adaptable-driving-beam headlamp of claim 7, wherein the plurality of film segments are arranged in a first array and a second array, the first array being positioned beside the second array such that the first array and the second array comprise a side-by-side arrangement of film segment arrays for shaping the beam pattern of light projected from the vehicle.

10. The adaptable-driving-beam headlamp of claim 7, wherein the plurality of film segments are arranged in a first array and a second array, the first array being shaped to provide a low-beam pattern of light and the second array being shaped to provide a high-beam pattern of light.

11. The adaptable-driving-beam headlamp of claim 10, wherein the second array comprises a high-beam cutoff such that the controller is configured to control the second array according to the high-beam cutoff for switching between a low-beam pattern and a high-beam pattern of light projected from the vehicle.

12. The adaptable-driving-beam headlamp of claim 7, wherein the beam pattern is adaptively shifted by actively switching a transparency state of the plurality of film segments to swivel a direction of light projected from the vehicle without using any moveable components or a motor.

13. The vehicle adaptable-driving-beam headlamp of claim 7, wherein the controller dims a portion of light projected from the vehicle via pulse-width modulation of a portion of the plurality of film segments.

14. The vehicle adaptable-driving-beam headlamp of claim 7, wherein the switchable electrochemical film is disposed between the at least one LED and the first lens, and the switchable electrochemical film is configured to reflect light from the at least one LED towards the first lens when switched to the substantially opaque state.

15. The vehicle adaptable-driving-beam headlamp of claim 7, wherein the switchable electrochemical film is disposed between the at least one LED and the first lens, and the switchable electrochemical film is configured to block light from the at least one LED to the first lens when switched to the substantially opaque state.

16. The vehicle adaptable-driving-beam headlamp of claim 7, wherein the switchable electrochemical film is disposed within the second lens, and the switchable electrochemical film is configured to filter light through the second lens based on the substantially transparent state or the substantially opaque state of each of the plurality of film segments.

17. The vehicle adaptable-driving-beam headlamp of claim 7, comprising a transparent anti-reflection coating disposed on an external side of the transparent substrate.

18. A switchable-mirror adaptable-driving-beam headlamp for a vehicle, comprising:

a switchable mirror comprising a plurality of electrochemical film segments arranged in one or more arrays;

a controller electrically coupled with the plurality of electrochemical film segments via a plurality of electrical leads attached to a peripheral end of each of the plurality of electrochemical film segments, respectively, such that each of the electrochemical film segments is individually controllable for switching between a substantially transparent state and a substantially reflective state; and a collimated light source directed at the switchable mirror such that each segment in the substantially reflective state reflects light from the collimated light source for projecting from a vehicle headlamp, and each segment in the substantially transparent state does not reflect light from the collimated light source.

19. The switchable-mirror adaptable-driving-beam headlamp of claim 18, further comprising a seal disposed on the switchable mirror, wherein the seal forms a barrier between a functional portion of the plurality of electrochemical film segments and the plurality of electrical leads.

20. The switchable-mirror adaptable-driving-beam headlamp of claim 18, wherein the collimated light source comprises a single light-emitting diode (LED).

* * * * *